US010658737B2

(12) United States Patent
Ashida et al.

(10) Patent No.: US 10,658,737 B2
(45) Date of Patent: May 19, 2020

(54) COMPOSITE ELECTRONIC COMPONENT

(71) Applicant: TDK CORPORATION, Tokyo (JP)

(72) Inventors: Yuta Ashida, Tokyo (JP); Yasuyuki Hara, Tokyo (JP); Toshiki Tate, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 16/103,123

(22) Filed: Aug. 14, 2018

(65) Prior Publication Data

US 2019/0097311 A1 Mar. 28, 2019

(30) Foreign Application Priority Data

Sep. 22, 2017 (JP) ..... 2017-181879

(51) Int. Cl.

| | |
|---|---|
| ***H01Q 9/04*** | (2006.01) |
| ***H01Q 1/36*** | (2006.01) |
| ***H01P 1/20*** | (2006.01) |
| ***H01P 3/18*** | (2006.01) |
| ***H01Q 1/48*** | (2006.01) |

(Continued)

(52) U.S. Cl.

CPC ..... *H01Q 1/36* (2013.01); *H01P 1/20* (2013.01); *H01P 1/20345* (2013.01); *H01P 3/18* (2013.01); *H01P 5/107* (2013.01); *H01Q 1/48* (2013.01); *H01Q 1/523* (2013.01);

(Continued)

(58) Field of Classification Search

CPC ..... H01Q 1/38; H01Q 1/48; H01Q 9/0407–9/0457; H01Q 21/06; H01Q 15/008; H01Q 19/005; H01P 1/20; H01P 3/18

See application file for complete search history.

(56) References Cited

U.S. PATENT DOCUMENTS 4,291,312 A * 9/1981 Kaloi ..... H01Q 1/48 343/700 MS
8,542,151 B2 * 9/2013 Lin ..... H01Q 21/065 343/700 MS (Continued)

FOREIGN PATENT DOCUMENTS

CN 105958167 A 9/2016
JP 2001-094336 A 4/2001

OTHER PUBLICATIONS

Translation of Sep. 23, 2019 Office Action in Chinese Patent Application No. 201811098771.3.

*Primary Examiner* — Dameon E Levi
*Assistant Examiner* — Hasan Z Islam
(74) *Attorney, Agent, or Firm* — Oliff PLC

(57) ABSTRACT

A composite electronic component includes a multilayer stack, a filter, and an antenna. The filter is located within the multilayer stack and interposed between a first ground conductor layer and a second ground conductor layer. The antenna includes a radiation element. The radiation element is located on a side of the second ground conductor layer opposite from the first ground conductor layer. When viewed in a direction parallel to the stacking direction of the multilayer stack, the radiation element entirely lies inside the perimeter of the second ground conductor layer. The multilayer stack includes a plurality of connection conductor sections arranged around the filter and connecting the first ground conductor layer and the second ground conductor layer.

10 Claims, 20 Drawing Sheets

(51) Int. Cl.

| | |
|---|---|
| ***H01P 1/203*** | (2006.01) |
| ***H01P 5/107*** | (2006.01) |
| ***H01Q 21/06*** | (2006.01) |
| ***H01Q 1/52*** | (2006.01) |

(52) U.S. Cl.
CPC ..... *H01Q 9/0407* (2013.01); *H01Q 9/0414* (2013.01); *H01Q 9/0457* (2013.01); *H01Q 21/065* (2013.01)

(56) References Cited

U.S. PATENT DOCUMENTS

| | | | | |
|---|---|---|---|---|
| 9,252,499 | B2 * | 2/2016 | Chen | H01Q 9/0457 |
| 2006/0055601 | A1 | 3/2006 | Kameda et al. | |
| 2009/0242242 | A1 * | 10/2009 | Ishii | H05K 3/326 174/254 |
| 2015/0207233 | A1 * | 7/2015 | Kim | H01Q 9/0485 343/785 |

* cited by examiner

COMPOSITE ELECTRONIC COMPONENT

BACKGROUND OF THE INVENTION

1. Field of the Invention

The present invention relates to a composite electronic component including a filter and an antenna.

2. Description of the Related Art

The standardization of fifth-generation mobile communication systems (hereinafter referred to as 5G) is currently ongoing. For 5G, the use of frequency bands of 10 GHz or higher, particularly a quasi-millimeter wave band of 10 to 30 GHz and a millimeter wave band of 30 to 300 GHz, is being studied to expand the frequency band.

Some communication apparatuses employ a configuration in which a filter is electrically connected to an antenna. The communication apparatuses having such a configuration may use a composite electronic component in which a filter and an antenna are integrated with each other by using a multilayer stack, as disclosed in, for example, JP 2001-094336A and US 2006/0055601 A1. The multilayer stack includes a plurality of dielectric layers and a plurality of conductor layers stacked together. Such a composite electronic component advantageously eliminates the need for adjustment of matching between the filter and the antenna and reduces the filter and antenna footprint.

In the composite electronic component disclosed in each of JP 2001-094336A and US 2006/0055601 A1, the filter is disposed between two ground conductor layers that are each connected to the ground, and a radiation element of the antenna is disposed on a side of one of the ground conductor layers opposite from the filter. In the composite electronic component having such a configuration, the two ground conductor layers form a structure similar to a parallel plate waveguide, thereby generating one or more propagation modes for electromagnetic waves. The one or more propagation modes for electromagnetic waves may generate one or more unwanted resonances, which may disadvantageously degrade the characteristics of the filter in the composite electronic component. For example, when the filter is a band-pass filter having a passband in the quasi-millimeter or millimeter wave band, even the lowest resonant frequency among the resonant frequencies of the one or more unwanted resonances is relatively close to the passband. This leads to degradation of the attenuation characteristic of the band-pass filter in a frequency region above the passband.

For the composite electronic component having the above-described configuration, there is another disadvantage that the radiation pattern of the antenna may be distorted due to the ground conductor layer interposed between the radiation element and the filter.

SUMMARY OF THE INVENTION

It is an object of the present invention to provide a composite electronic component including a filter and an antenna electrically connected to each other, the composite electronic component being capable of preventing degradation in the characteristics of the filter and distortion of the radiation pattern of the antenna.

A composite electronic component of the present invention includes a multilayer stack including a plurality of dielectric layers and a plurality of conductor layers that are stacked in a first direction. The composite electronic component further includes one or more filters and one or more antennas making up one or more filter-antenna pairs. Each of the one or more filter-antenna pairs is made up of one filter of the one or more filters and one antenna of the one or more antennas, wherein the one filter and the one antenna are electrically connected to each other.

The plurality of conductor layers include a first ground conductor layer and a second ground conductor layer each connected to a ground. The first ground conductor layer and the second ground conductor layer are located at different positions in the first direction. The filter lies within a spatial range from the first ground conductor layer to the second ground conductor layer.

The antenna includes a radiation element formed of one of the plurality of conductor layers. The radiation element is located on a side of the second ground conductor layer opposite from the first ground conductor layer. When viewed in a direction parallel to the first direction, the radiation element entirely lies inside the perimeter of the second ground conductor layer.

The multilayer stack further includes a plurality of connection conductor sections for connecting the first ground conductor layer and the second ground conductor layer. The plurality of connection conductor sections are arranged around the filter such that one or more of the connection conductor sections are situated to each of the front and the rear of the filter in each of a second direction and a third direction. The second direction and the third direction are orthogonal to the first direction and orthogonal to each other.

In the composite electronic component of the present invention, each of the plurality of connection conductor sections may include a plurality of through holes connected in series.

In the composite electronic component of the present invention, the filter may be a band-pass filter including a plurality of resonators. In such a case, the plurality of connection conductor sections may be arranged with a spacing between adjacent ones of the connection conductor sections, the spacing being smaller than or equal to ¼ a wavelength corresponding to the center frequency of the passband of the band-pass filter. The plurality of resonators may respectively include resonator conductor sections each shaped to be long in a direction intersecting the first direction. Each of the plurality of connection conductor sections may be situated such that a distance from a nearest one of the resonator conductor sections is smaller than or equal to ¼ the wavelength corresponding to the center frequency of the passband of the band-pass filter.

In the composite electronic component of the present invention, the plurality of connection conductor sections may be arranged with a spacing of 1.25 mm or less between adjacent ones of the connection conductor sections.

In the composite electronic component of the present invention, the one or more filter-antenna pairs may be a plurality of filter-antenna pairs. In such a case, the one or more filters are a plurality of filters, and the one or more antennas are a plurality of antennas. A plurality of sets of the plurality of connection conductor sections are provided to correspond to the plurality of filter-antenna pairs. The plurality of antennas include their respective radiation elements. When viewed in a direction parallel to the first direction, all the radiation elements entirely lie inside the perimeter of the second ground conductor layer. The first ground conductor layer may include a plurality of partial conductor layers respectively corresponding to the plurality of filter-antenna pairs. The plurality of partial conductor layers are separated from each other.

In the composite electronic component of the present invention, the multilayer stack includes the plurality of connection conductor sections. This configuration prevents degradation of the characteristics of the filter resulting from the first and second ground conductor layers. Further, according to the present invention, when viewed in a direction parallel to the first direction, the radiation element entirely lies inside the perimeter of the second ground conductor layer. This configuration prevents distortion of the radiation pattern of the antenna resulting from the second ground conductor layer.

Other and further objects, features and advantages of the invention will appear more fully from the following description.

DETAILED DESCRIPTION OF THE PREFERRED EMBODIMENT

Figure 1:
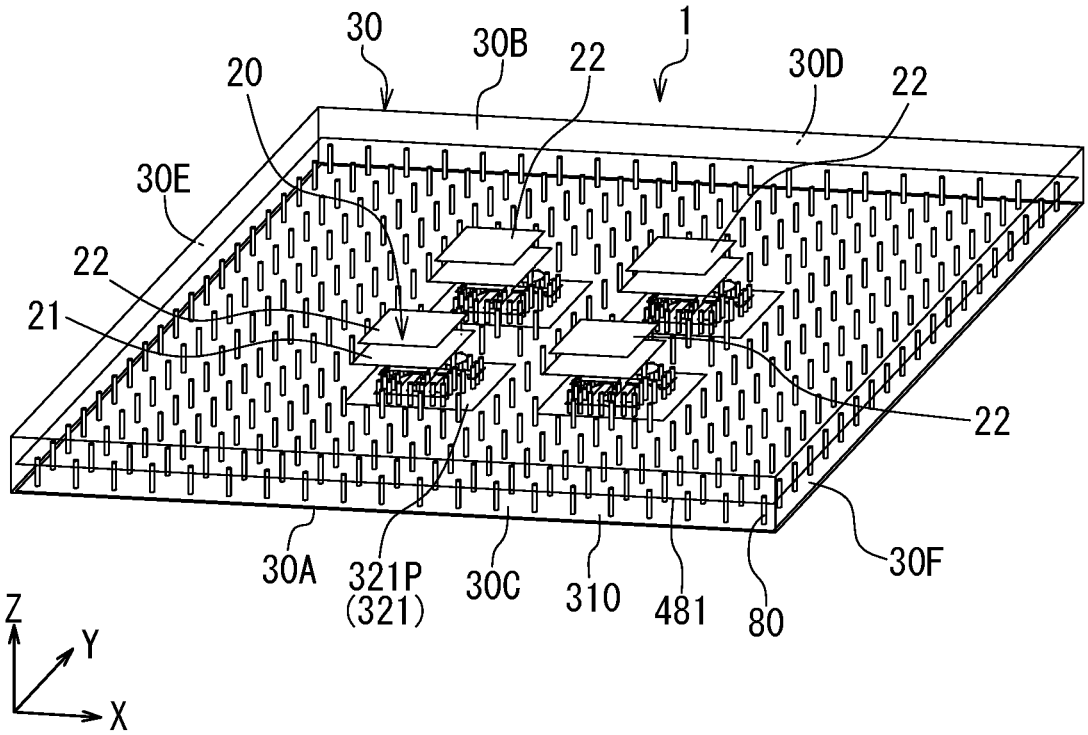
FIG. 1 is a perspective view showing the structure of a composite electronic component according to an embodiment of the invention.
Figure 2:
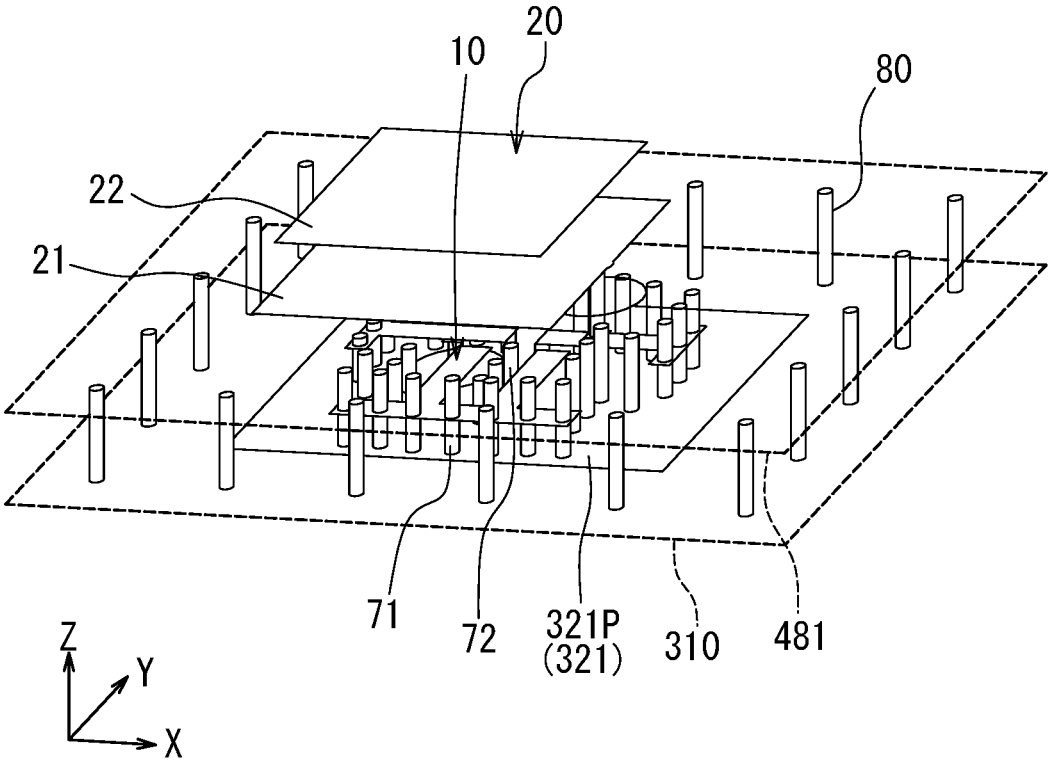
FIG. 2 is a perspective view showing part of FIG. 1 on an enlarged scale.
Figure 3:
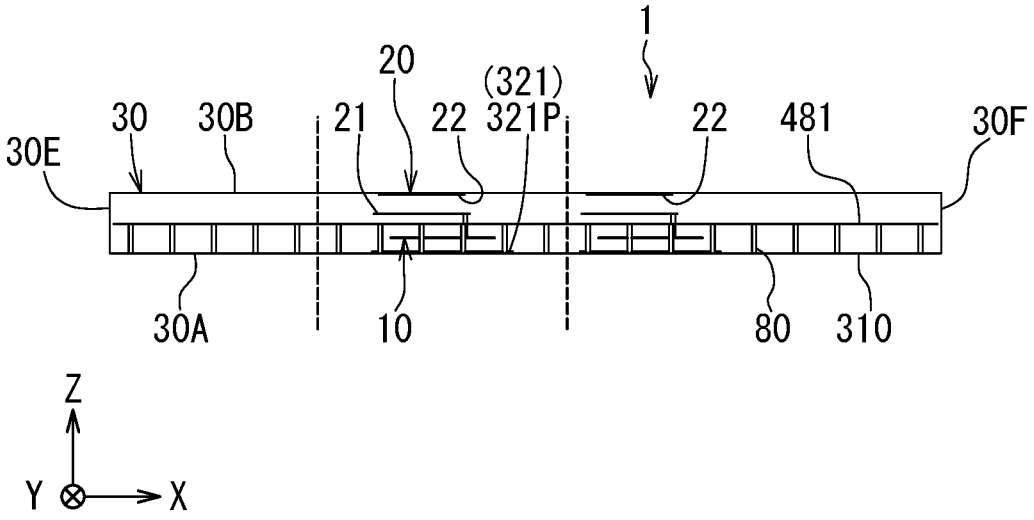
FIG. 3 is a side view of the composite electronic component shown in FIG. 1.
Figure 4:
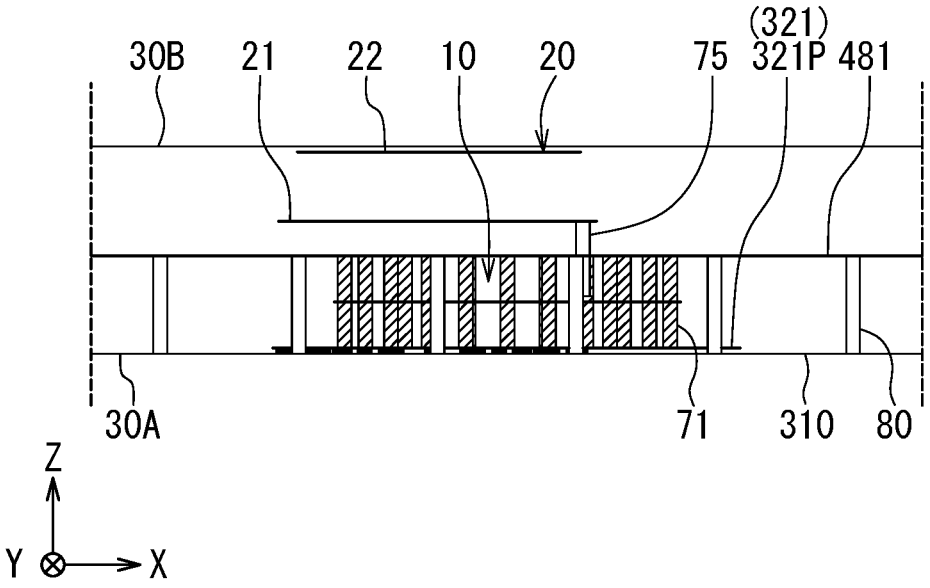
FIG. 4 is a side view showing part of FIG. 3 on an enlarged scale.
Figure 5:
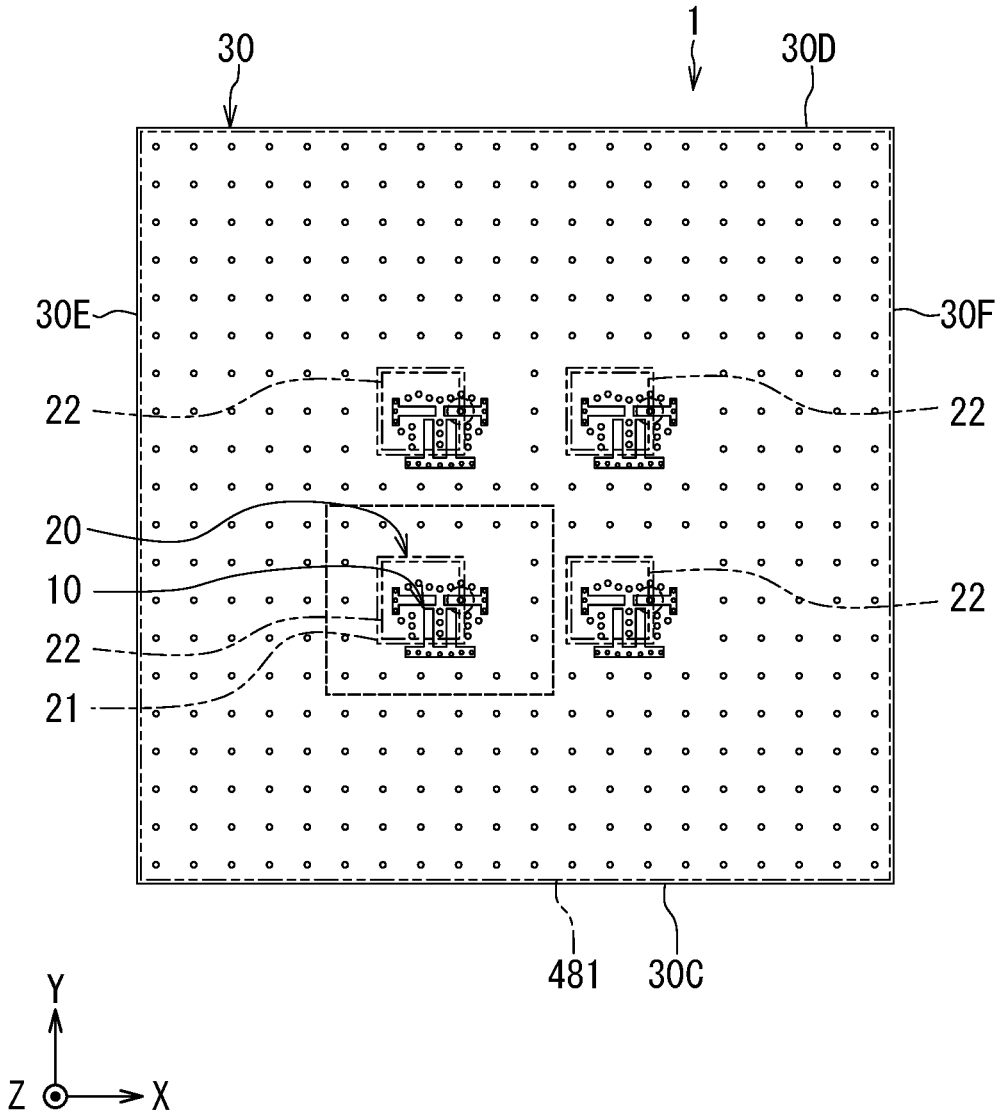
FIG. 5 is a plan view of the composite electronic component shown in FIG. 1.
Figure 6:
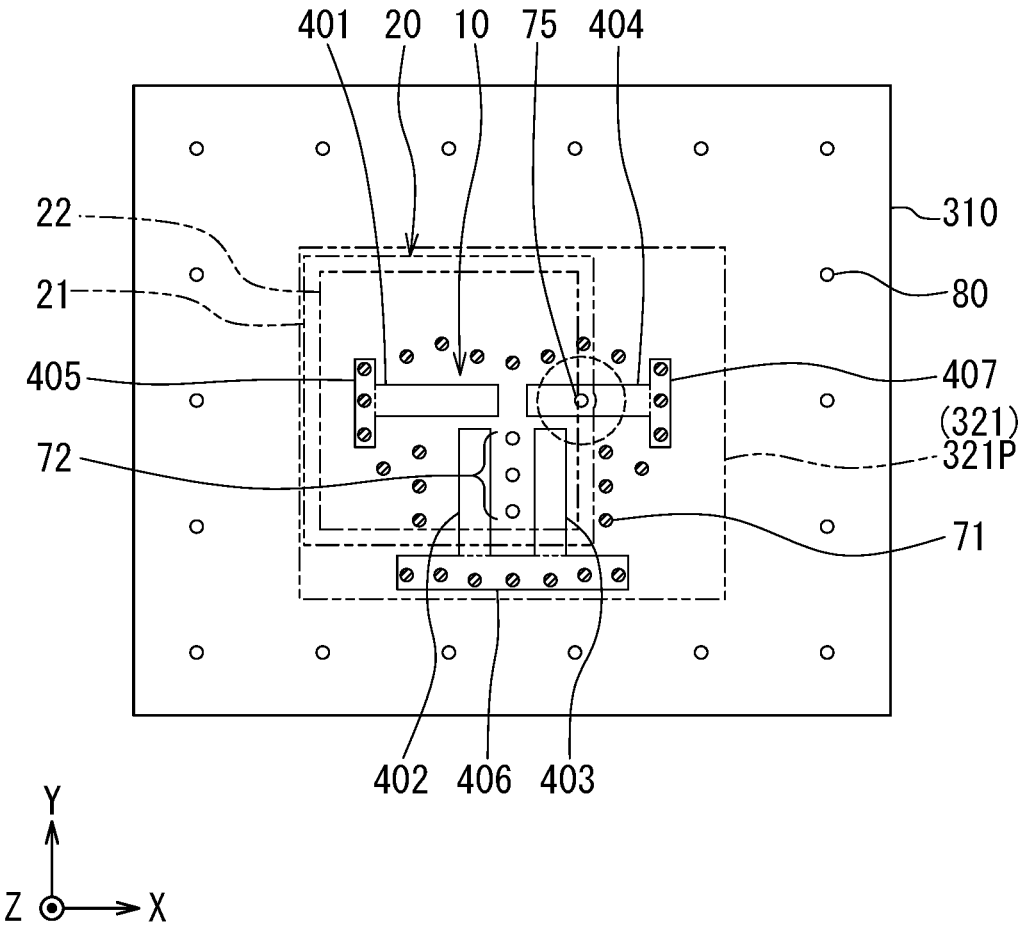
FIG. 6 is a plan view showing part of FIG. 5 on an enlarged scale.

A composite electronic component according to a preferred embodiment of the present invention will be described in detail below with reference to the drawings. First, reference is made to FIG. 1 to FIG. 6 to describe the structure of the composite electronic component according to the embodiment. FIG. 1 is a perspective view showing the structure of the composite electronic component. FIG. 2 is a perspective view showing part of FIG. 1 on an enlarged scale. FIG. 3 is a side view of the composite electronic component shown in FIG. 1. FIG. 4 is a side view showing part of FIG. 3 on an enlarged scale. FIG. 5 is a plan view of the composite electronic component shown in FIG. 1. FIG. 6 is a plan view showing part of FIG. 5 on an enlarged scale.

As shown in FIG. 1 to FIG. 3, the composite electronic component 1 according to the embodiment includes a multilayer stack 30. As will be described in detail later, the multilayer stack 30 includes a plurality of dielectric layers and a plurality of conductor layers that are stacked in a first direction.

The composite electronic component 1 further includes one or more filters 10 and one or more antennas 20 making up one or more filter-antenna pairs. Each of the one or more filter-antenna pairs is made up of one filter 10 of the one or more filters 10 and one antenna 20 of the one or more antennas 20, wherein the one filter 10 and the one antenna 20 are electrically connected to each other.

In the embodiment, specifically, the composite electronic component 1 includes a plurality of filters 10 and a plurality of antennas 20 making up a plurality of filter-antenna pairs. More specifically, the number of the filters 10, the number of the antennas 20, and the number of the filter-antenna pairs are all four. FIGS. 2, 4 and 6 show a portion of the multilayer stack 30, which includes one filter-antenna pair, on an enlarged scale. In FIGS. 3 and 5, the bounds of this portion are indicated by broken lines.

Now, we define X, Y and Z directions as shown in FIG. 1. The X, Y and Z directions are orthogonal to one another. The Z direction is the direction in which the plurality of dielectric layers of the multilayer stack 30 are stacked, and corresponds to the first direction mentioned above. The X direction corresponds to the second direction in the present invention. The Y direction corresponds to the third direction in the present invention.

The multilayer stack 30 is in the shape of a rectangular solid. The multilayer stack 30 has a top surface 30B and a bottom surface 30A opposite to each other. The bottom surface 30A is to face the surface of a mounting object such as a mounting substrate when the composite electronic component 1 is mounted thereonto. The multilayer stack 30 further has four side surfaces 30C, 30D, 30E and 30F connecting the top surface 30B and the bottom surface 30A. The top surface 30B and the bottom surface 30A are located at opposite ends of the multilayer stack 30 in the Z direction. The side surfaces 30C and 30D are located at opposite ends of the multilayer stack 30 in the Y direction. The side surfaces 30E and 30F are located at opposite ends of the multilayer stack 30 in the X direction.

The plurality of conductor layers of the multilayer stack 30 include a bottom ground conductor layer 310, a first ground conductor layer 321, and a second ground conductor layer 481, each connected to the ground. The bottom ground conductor layer 310 is exposed in the bottom surface 30A. The first ground conductor layer 321 and the second ground conductor layer 481 are located at different positions in the Z direction. To be more specific, the first ground conductor layer 321 is located closer to the bottom surface 30A than is the second ground conductor layer 481. Each filter 10 lies within a spatial range from the first ground conductor layer 321 to the second ground conductor layer 481.

Each antenna 20 includes a feed conductor layer 21 and a radiation element 22, each of which is formed of one of the plurality of conductor layers. The radiation element 22 is located on a side of the second ground conductor layer 481 opposite from the first ground conductor layer 321. The feed conductor layer 21 is located between the second ground conductor layer 481 and the radiation element 22 in the Z direction. The radiation element 22 is opposed to the feed conductor layer 21.

In the embodiment, since the number of the filter-antenna pairs is four, the multilayer stack 30 includes four radiation elements 22.

In the embodiment, the first ground conductor layer 321 includes four partial conductor layers 321P respectively corresponding to the four filter-antenna pairs. The four partial conductor layers 321P are separated from each other.

The second ground conductor layer 481 is constituted of a single conductor layer. When viewed in a direction parallel to the Z direction, the radiation element 22 entirely lies inside the perimeter of the second ground conductor layer 481. In the embodiment, as shown in FIG. 5, all the four radiation elements 22 entirely lie inside the perimeter of the second ground conductor layer 481 when viewed in a direction parallel to the Z direction.

Figure 7:
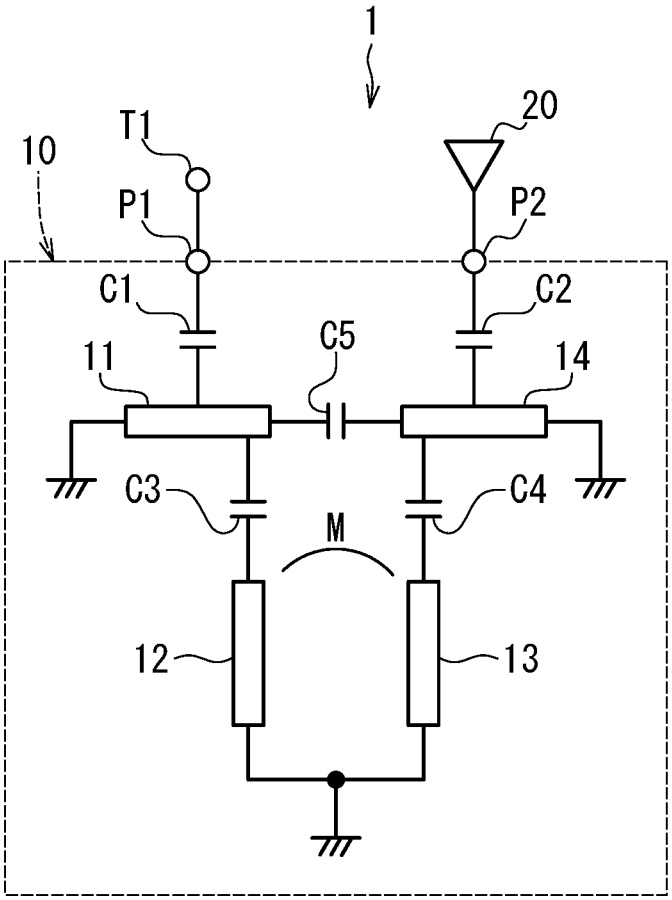
FIG. 7 is a circuit diagram showing the circuit configuration of a filter-antenna pair in the composite electronic component according to the embodiment of the invention.

FIG. 7 is a circuit diagram showing the circuit configuration of one filter-antenna pair in the composite electronic component 1. The composite electronic component 1 includes four filters 10 and four antennas 20 making up four filter-antenna pairs. The composite electronic component 1 further includes four input/output terminals T1 respectively connected to the four filters 10. FIG. 7 shows one of the four input/output terminals T1. In the embodiment, the filters 10 are specifically band-pass filters. The filter(s) 10 will hereinafter be referred to as band-pass filter(s) 10.

Each band-pass filter 10 includes, as shown in FIG. 7, a first input/output port P1 connected to the input/output terminal T1, a second input/output port P2, and a plurality of resonators. The plurality of resonators are provided between the first input/output port P1 and the second input/output port P2 in circuit configuration. The phrase "in circuit configuration" herein is used to describe layout in a circuit diagram, not in a physical configuration.

In the embodiment, the plurality of resonators include a first-stage resonator 11, a second-stage resonator 12, a third-stage resonator 13, and a fourth-stage resonator 14, which are listed in descending order of proximity to the first input/output port P1 in circuit configuration. The resonators 11 to 14 are configured so that two resonators adjacent to each other in circuit configuration are electromagnetically coupled to each other. More specifically, the resonators 11 to 14 are configured so that: the resonators 11 and 12 are adjacent to each other in circuit configuration and are electromagnetically coupled to each other; the resonators 12 and 13 are adjacent to each other in circuit configuration and are electromagnetically coupled to each other; and the resonators 13 and 14 are adjacent to each other in circuit configuration and are electromagnetically coupled to each other.

Each of the resonators 11 to 14 has a first end and a second end which are opposite to each other in circuit configuration. The second end of each of the resonators 11 to 14 is connected to the ground.

Each band-pass filter 10 further includes a capacitor C1 provided between the first input/output port P1 and the first-stage resonator 11, and a capacitor C2 provided between the second input/output port P2 and the fourth-stage resonator 14.

In FIG. 7, the capacitor symbol C3 represents capacitive coupling between the resonators 11 and 12. The capacitor symbol C4 represents capacitive coupling between the resonators 13 and 14. The curve labeled M represents magnetic coupling between the resonators 12 and 13. In this embodiment, the first-stage resonator 11 and the fourth-stage resonator 14 are configured to be capacitively coupled to each other. In FIG. 7, the capacitor symbol C5 represents the capacitive coupling between the resonators 11 and 14.

The resonators 11, 12, 13 and 14 respectively include, as shown in FIG. 6, resonator conductor sections 401, 402, 403 and 404 which are each shaped to be long in a direction intersecting the Z direction.

The multilayer stack 30 further includes shield conductor sections 405, 406, and 407 as shown in FIG. 6. The shield conductor sections 405, 406, and 407 are connected to the ground. The resonator conductor section 401 and the shield conductor section 405 are different portions of a single conductor layer. The resonator conductor sections 402 and 403 and the shield conductor section 406 are different portions of another single conductor layer. The resonator conductor section 404 and the shield conductor section 407 are different portions of still another single conductor layer. In FIG. 6, the boundary between the resonator conductor section 401 and the shield conductor section 405, the boundary between the resonator conductor section 402 and the shield conductor section 406, the boundary between the resonator conductor section 403 and the shield conductor section 406, and the boundary between the resonator conductor section 404 and the shield conductor section 407 are indicated by broken lines.

The resonator conductor section 401 and the resonator conductor section 404 are shaped to be long in the X direction. The resonator conductor section 402 and the resonator conductor section 403 are shaped to be long in the Y direction. Each of the resonator conductor sections 401, 402, 403, and 404 has a first end and a second end opposite to each other in the longitudinal direction. The first end of each of the resonator conductor sections 401, 402, 403, and 404 is open. The second end of the resonator conductor section 401 is connected to the shield conductor section 405, and thereby connected to the ground. The second end of each of the resonator conductor sections 402 and 403 is connected to the shield conductor section 406, and thereby connected to the ground. The second end of the resonator conductor section 404 is connected to the shield conductor section 407, and thereby connected to the ground.

Each of the resonator conductor sections 401, 402, 403, and 404 has a length smaller than or equal to ¼ the wavelength corresponding to the center frequency of the passband of the band-pass filter 10. In the embodiment, the length of each of the resonator conductor sections 401, 402, 403, and 404 is equal to ¼ the wavelength corresponding to the center frequency of the passband of the band-pass filter 10.

The multilayer stack 30 further includes a plurality of connection conductor sections 71 connecting the first ground conductor layer 321 and the second ground conductor layer 481. Each of the connection conductor sections 71 includes a plurality of through holes connected in series. For the sake of convenience, the connection conductor sections 71 are shown with hatching in FIGS. 4 and 6.

A plurality of sets of the plurality of connection conductor sections 71 are provided to correspond to the plurality of filter-antenna pairs. In the embodiment, since the number of the filter-antenna pairs is four, there are provided four sets of the plurality of connection conductor sections 71.

As shown in FIG. 6, a number of connection conductor sections 71 among the plurality of connection conductor sections 71 are connected to each of the shield conductor sections 405, 406 and 407. The remainder of the plurality of connection conductor sections 71 are connected to none of the shield conductor sections 405, 406 and 407.

The multilayer stack 30 further includes a plurality of partition conductor sections 72 connecting the first ground conductor layer 321 and the second ground conductor layer 481. The plurality of partition conductor sections 72 are located between the resonator conductor sections 402 and 403 when viewed in a direction parallel to the Z direction. Each of the plurality of partition conductor sections 72 includes a plurality of through holes connected in series. Four sets of the plurality of partition conductor sections 72 are provided to correspond to the four band-pass filters 10.

As shown in FIGS. 1 to 4, the multilayer stack 30 further includes a plurality of through hole lines 80 connecting the bottom ground conductor layer 310 and the second ground conductor layer 481. The plurality of through hole lines 80 are arranged around the four band-pass filters 10 when viewed in a direction parallel to the Z direction. Each of the through hole lines 80 includes a plurality of through holes connected in series.

The multilayer stack 30 further includes four through hole lines 75 corresponding to the four filter-antenna pairs. As will be described in detail later, each of the four through hole lines 75 connects the capacitor C2 and the feed conductor layer 21. Each of the through hole lines 75 includes a plurality of through holes connected in series.

The operation of the composite electronic component 1 according to the embodiment will now be described. The band-pass filter 10 selectively passes, among high-frequency signals received at one of the first and second input/output ports P1 and P2, a signal of a frequency within the passband, and allows the signal to be outputted from the other of the first and second input/output ports P1 and P2. For example, the band-pass filter 10 is designed and configured to have a passband in a quasi-millimeter wave band of 10 to 30 GHz or a millimeter wave band of 30 to 300 GHz.

The feed conductor layer 21 of the antenna 20 is connected to the second input/output port P2. The radiation element 22 is configured to be electromagnetically coupled to the feed conductor layer 21. Once a high-frequency signal outputted from the second input/output port P2 of the band-pass filter 10 has been received at the feed conductor layer 21, the feed conductor layer 21 and the radiation element 22 convert the high-frequency signal into electromagnetic waves, and allow the electromagnetic waves to be radiated from the radiation element 22. On the other hand, once the radiation element 22 has received electromagnetic waves, the radiation element 22 and the feed conductor layer 21 convert the electromagnetic waves into a high-frequency signal, and transmit the high-frequency signal to the second input/output port P2.

The composite electronic component 1 according to the embodiment is provided with a plurality of, more specifically, four, filter-antenna pairs. The composite electronic component 1 can be used to construct an array antenna.

Reference is now made to FIGS. 8A to 18B to describe the dielectric layers constituting the multilayer stack 30, and the configurations of the conductor layers formed on the dielectric layers and the through holes formed in the dielectric layers. Fig. nA (n is an integer between 8 and 18 inclusive) shows the patterned surface of a dielectric layer, and Fig. nB shows an enlarged view of a portion outlined by a dashed line box in Fig. nA. Such a portion corresponds to the portion shown in FIGS. 2, 4 and 6. In Fig. mB (m is an integer between 9 and 14 inclusive), for the sake of convenience, the through holes used to form the connection conductor sections 71 are indicated with hatching.

The multilayer stack 30 includes thirty-six dielectric layers stacked together. The thirty-six dielectric layers will be referred to as the first to thirty-sixth dielectric layers in the order from bottom to top. The first to thirty-sixth dielectric layers will be denoted by reference numerals 31 to 66.

Figure 8A:
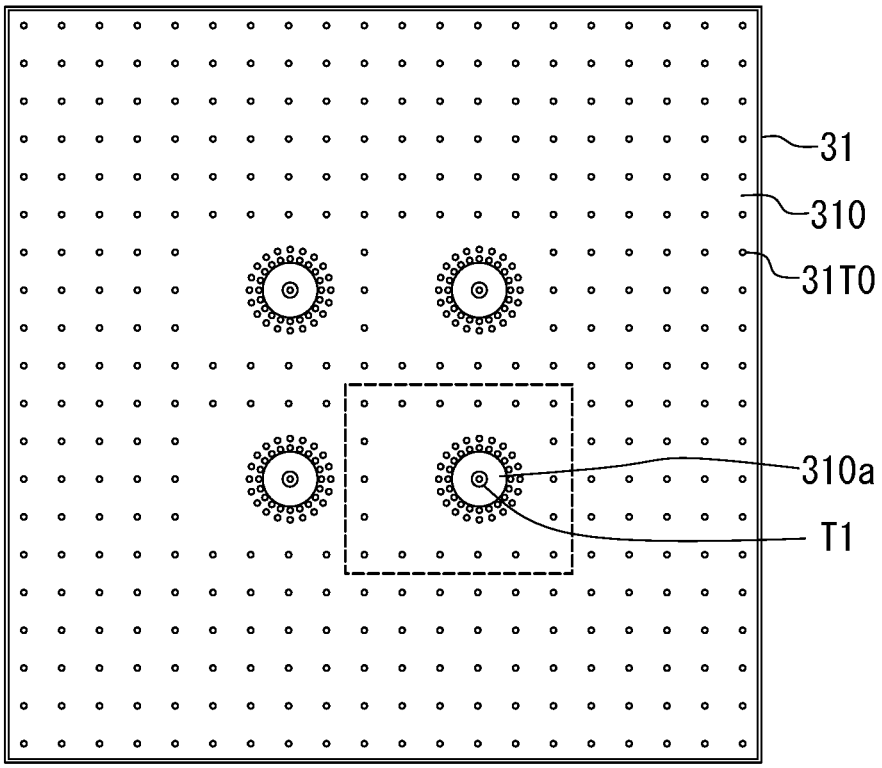
FIGS. 8A and 8B are explanatory diagrams showing a patterned surface of a first dielectric layer of the multilayer stack shown in FIG. 1.
Figure 8B:
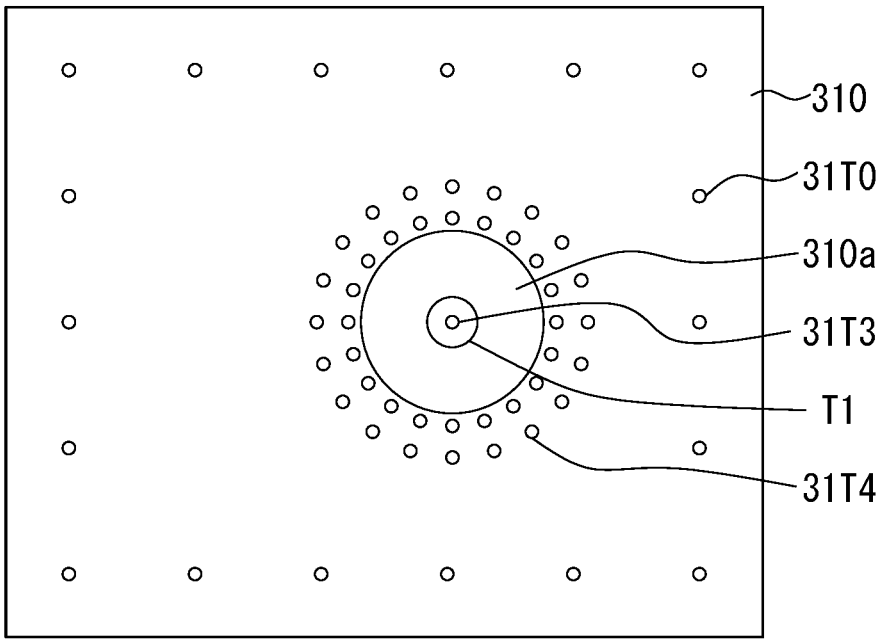

As shown in FIGS. 8A and 8B, the bottom ground conductor layer 310 and the four input/output terminals T1 are formed on the patterned surface of the first dielectric layer 31. Four circular holes 310*a* are formed in the bottom ground conductor layer 310. The four input/output terminals T1 are respectively located inside the four holes 310*a*, and are not in contact with the bottom ground conductor layer 310.

In the dielectric layer 31, there are formed four through holes 31T3 connected to the four input/output terminals T1.

Further formed in the dielectric layer 31 are a plurality of through holes 31T0 connected to the bottom ground conductor layer 310. The plurality of through holes 31T0 are used to form the plurality of through hole lines 80.

Further formed in the dielectric layer 31 are four sets of a plurality of through holes 31T4. The plurality of through holes 31T4 constituting each of the four sets are arranged around a corresponding one of the four holes 310*a*, and are connected to the bottom ground conductor layer 310.

Figure 9A:
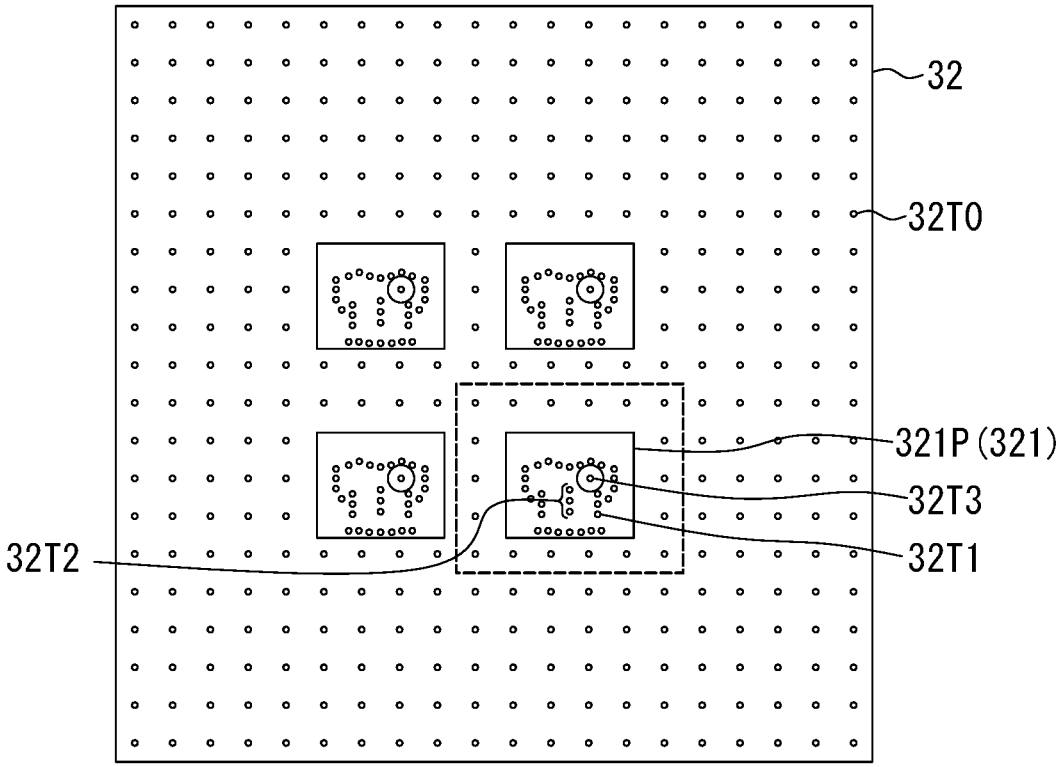
FIGS. 9A and 9B are explanatory diagrams showing a patterned surface of a second dielectric layer of the multilayer stack shown in FIG. 1.
Figure 9B:
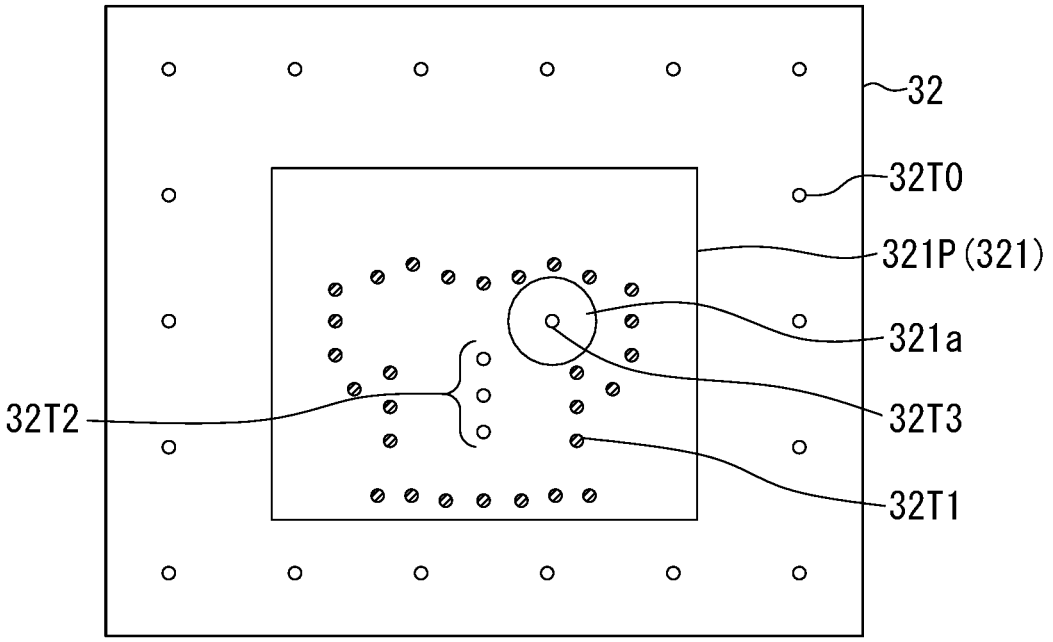

On the patterned surface of the second dielectric layer 32, as shown in FIGS. 9A and 9B, there are formed four partial conductor layers 321P constituting the first ground conductor layer 321. Four circular holes 321*a* are respectively formed in the four partial conductor layers 321P.

In the dielectric layer 32, there are formed four through holes 32T3 inside the four holes 321*a*, respectively. The four through holes 31T3 formed in the dielectric layer 31 are connected to the four through holes 32T3.

Further formed in the dielectric layer 32 are a plurality of through holes 32T0 for forming the plurality of through hole lines 80. The plurality of through holes 31T0 formed in the dielectric layer 31 are connected to the plurality of through holes 32T0.

Further formed in the dielectric layer 32 are four sets of a plurality of through holes 32T1 and four sets of a plurality of through holes 32T2. The four sets of the plurality of through holes 32T1 are used to form the four sets of the plurality of connection conductor sections 71. The four sets of the plurality of through holes 32T2 are used to form the four sets of the plurality of partition conductor sections 72.

The four sets of the plurality of through holes 31T4 formed in the dielectric layer 31 are connected to the four partial conductor layers 321P.

Figure 10A:
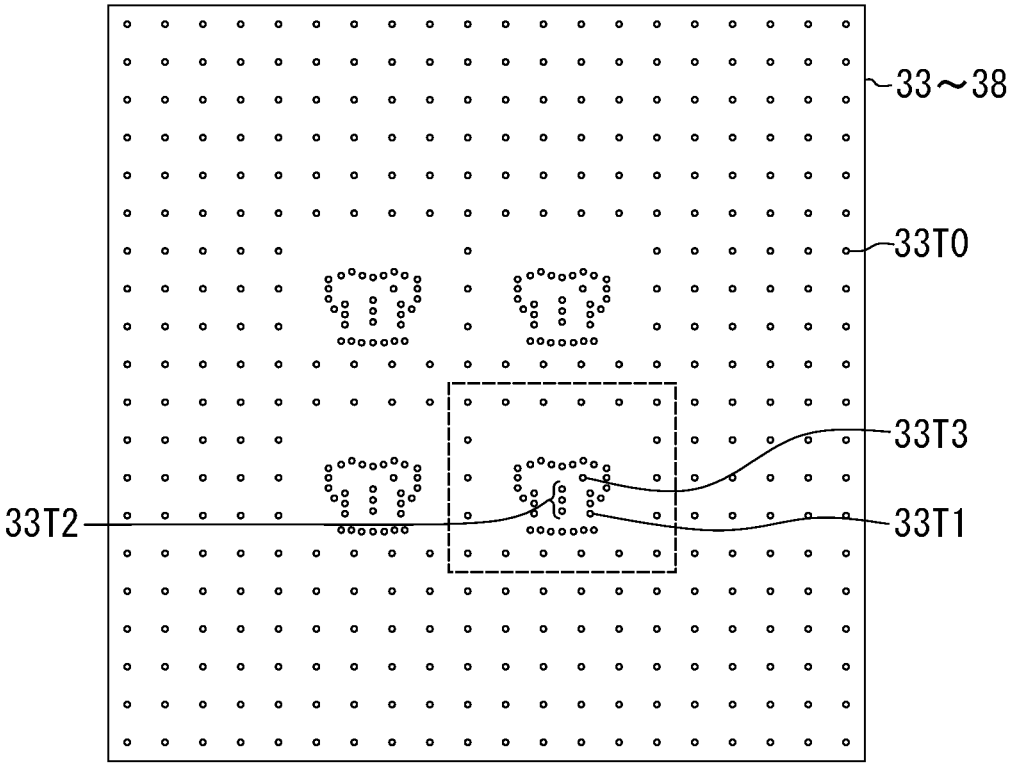
FIGS. 10A and 10B are explanatory diagrams showing a patterned surface of each of a third to an eighth dielectric layer of the multilayer stack shown in FIG. 1.
Figure 10B:
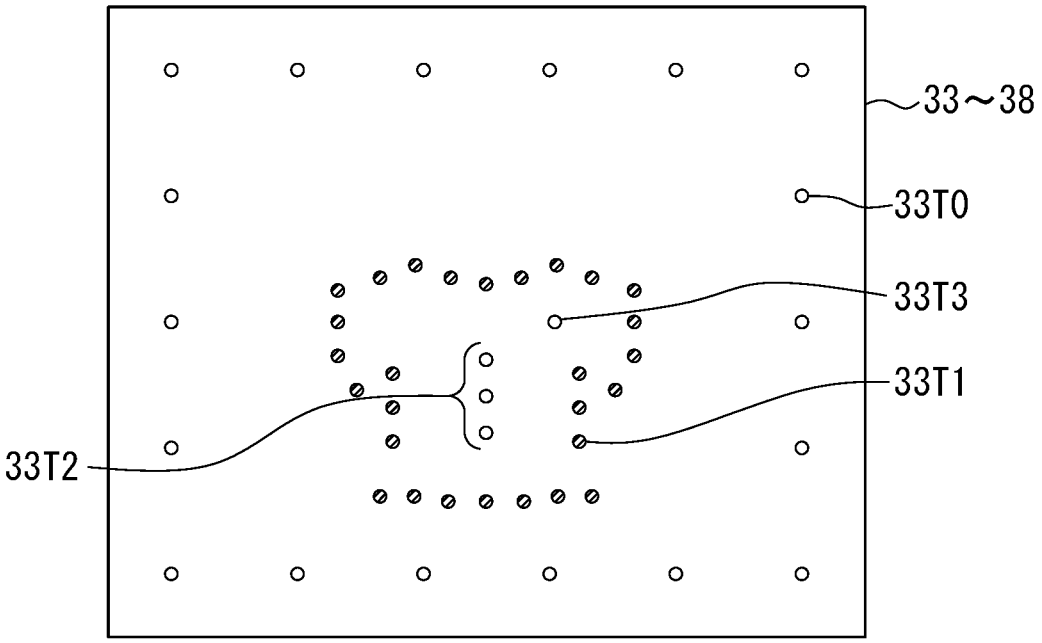

As shown in FIGS. 10A and 10B, a plurality of through holes 33T0 for forming the plurality of through hole lines 80 are formed in each of the third to eighth dielectric layers 33 to 38. Further, four sets of a plurality of through holes 33T1 and four sets of a plurality of through holes 33T2 are formed in each of the dielectric layers 33 to 38. The four sets of the plurality of through holes 33T1 are used to form the four sets of the plurality of connection conductor sections 71. The four sets of the plurality of through holes 33T2 are used to form the four sets of the plurality of partition conductor sections 72. Further, four through holes 33T3 are formed in each of the dielectric layers 33 to 38.

The plurality of through holes 32T0 formed in the dielectric layer 32 are connected to the plurality of through holes 33T0 formed in the third dielectric layer 33. The four sets of the plurality of through holes 32T1 formed in the dielectric layer 32 are connected to the four sets of the plurality of through holes 33T1 formed in the dielectric layer 33. The four sets of the plurality of through holes 32T2 formed in the dielectric layer 32 are connected to the four sets of the plurality of through holes 33T2 formed in the dielectric layer 33. The four through holes 32T3 formed in the dielectric layer 32 are connected to the four through holes 33T3 formed in the dielectric layer 33. Each of the four through holes 33T3 formed in the eighth dielectric layer 38 corresponds to the first input/output port P1.

In the dielectric layers 33 to 38, every vertically adjacent through holes denoted by the same reference signs are connected to each other.

Figure 11A:
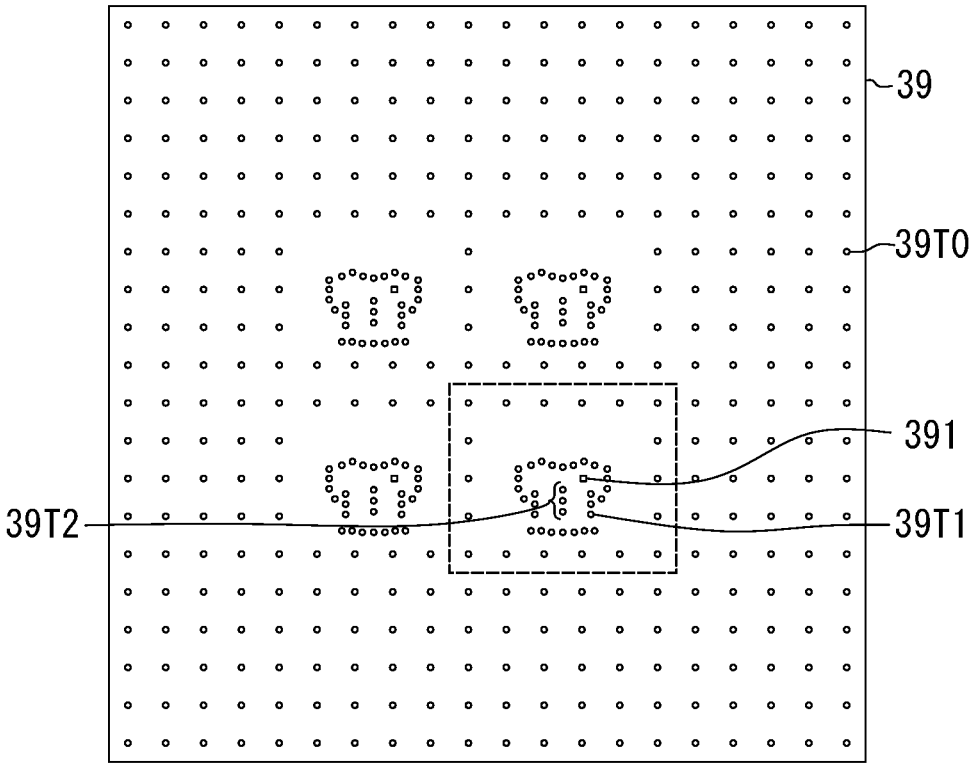
FIGS. 11A and 11B are explanatory diagrams showing a patterned surface of a ninth dielectric layer of the multilayer stack shown in FIG. 1.
Figure 11B:
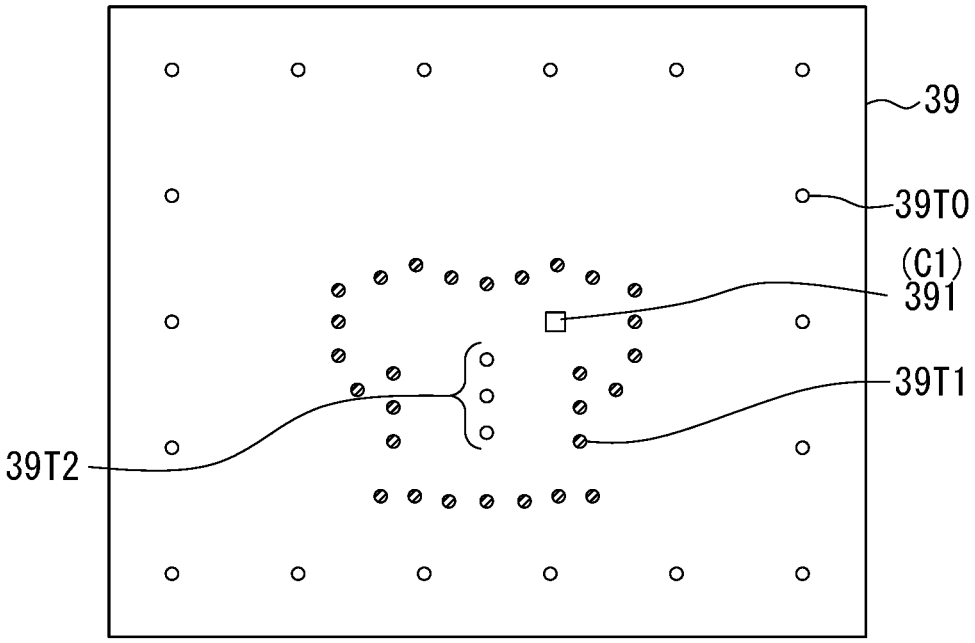

On the patterned surface of the ninth dielectric layer 39, as shown in FIGS. 11A and 11B, there are formed four conductor layers 391 for forming four capacitors C1 of the four band-pass filters 10. The four through holes 33T3 formed in the eighth dielectric layer 38 are connected to the four conductor layers 391.

Further formed in the dielectric layer 39 are: a plurality of through holes 39T0 for forming the plurality of through hole lines 80; four sets of a plurality of through holes 39T1 for forming the four sets of the plurality of connection conductor sections 71; and four sets of a plurality of through holes 39T2 for forming the four sets of the plurality of partition conductor sections 72.

The plurality of through holes 33T0 formed in the dielectric layer 38 are connected to the plurality of through holes 39T0. The four sets of the plurality of through holes 33T1 formed in the dielectric layer 38 are connected to the four sets of the plurality of through holes 39T1. The four sets of the plurality of through holes 33T2 formed in the dielectric layer 38 are connected to the four sets of the plurality of through holes 39T2.

Figure 12A:
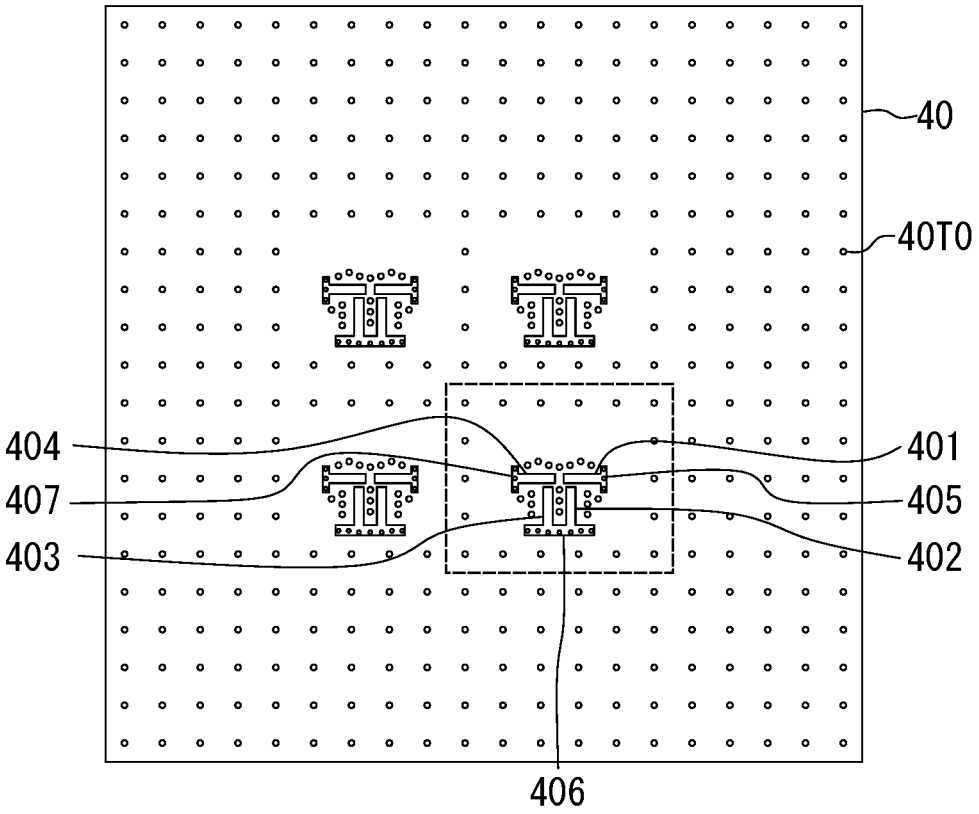
FIGS. 12A and 12B are explanatory diagrams showing a patterned surface of a tenth dielectric layer of the multilayer stack shown in FIG. 1.
Figure 12B:
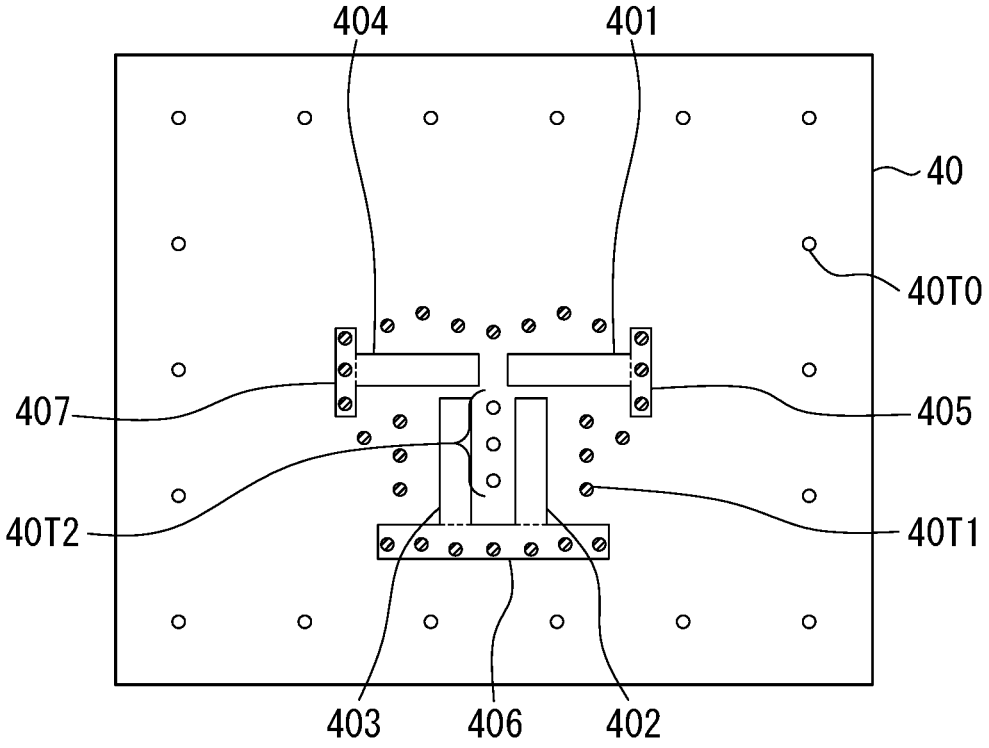

On the patterned surface of the tenth dielectric layer 40, as shown in FIGS. 12A and 12B, there are formed four sets of conductor layers corresponding to the four band-pass filters 10, each set of conductor layers being constituted of three conductor layers, i.e., a conductor layer for forming the resonator conductor section 401 and the shield conductor section 405, a conductor layer for forming the resonator conductor sections 402 and 403 and the shield conductor section 406, and a conductor layer for forming the resonator conductor section 404 and the shield conductor section 407. The four conductor layers 391 formed on the patterned surface of the ninth dielectric layer 30 are respectively opposed to the four resonator conductor sections 401 with the dielectric layer 39 interposed therebetween.

Further formed in the dielectric layer 40 are: a plurality of through holes 40T0 for forming the plurality of through hole lines 80; four sets of a plurality of through holes 40T1 for forming the four sets of the plurality of connection conductor sections 71; and four sets of a plurality of through holes 40T2 for forming the four sets of the plurality of partition conductor sections 72.

The plurality of through holes 39T0 formed in the dielectric layer 39 are connected to the plurality of through holes 40T0. The four sets of the plurality of through holes 39T1 formed in the dielectric layer 39 are connected to the four sets of the plurality of through holes 40T1. The four sets of the plurality of through holes 39T2 formed in the dielectric layer 39 are connected to the four sets of the plurality of through holes 40T2.

A number of through holes 40T1 among the plurality of through holes 40T1 are connected to each of the shield conductor sections 405, 406, and 407. The remainder of the plurality of through holes 40T1 are connected to none of the shield conductor sections 405, 406, and 407.

Figure 13A:
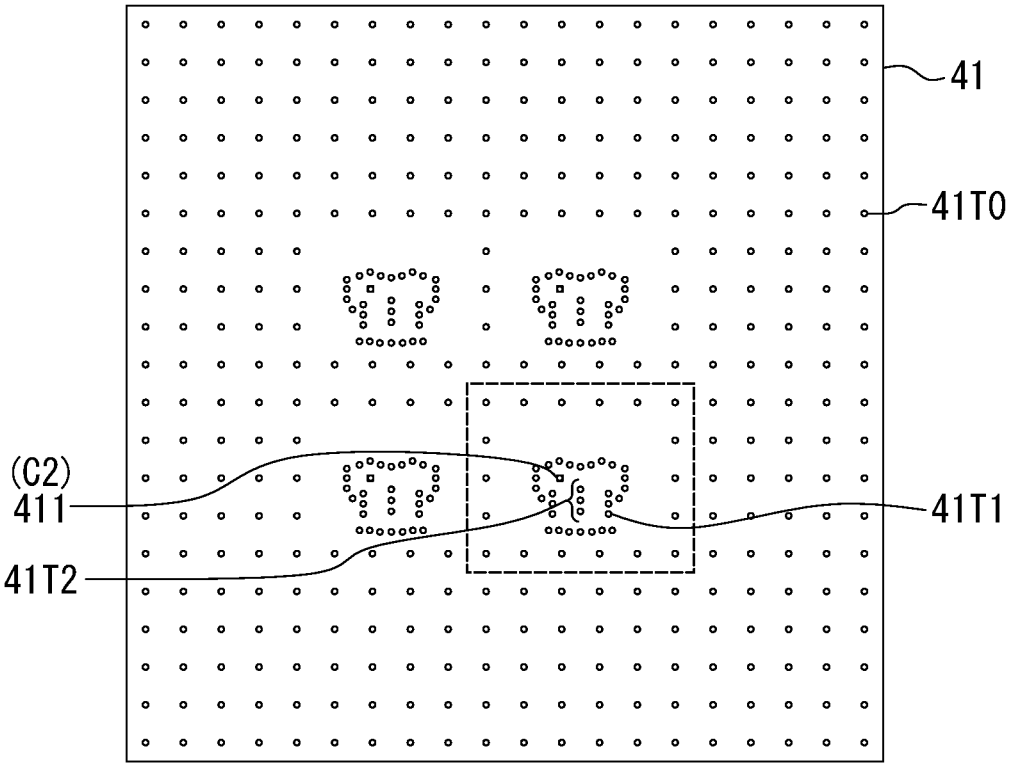
FIGS. 13A and 13B are explanatory diagrams showing a patterned surface of an eleventh dielectric layer of the multilayer stack shown in FIG. 1.
Figure 13B:
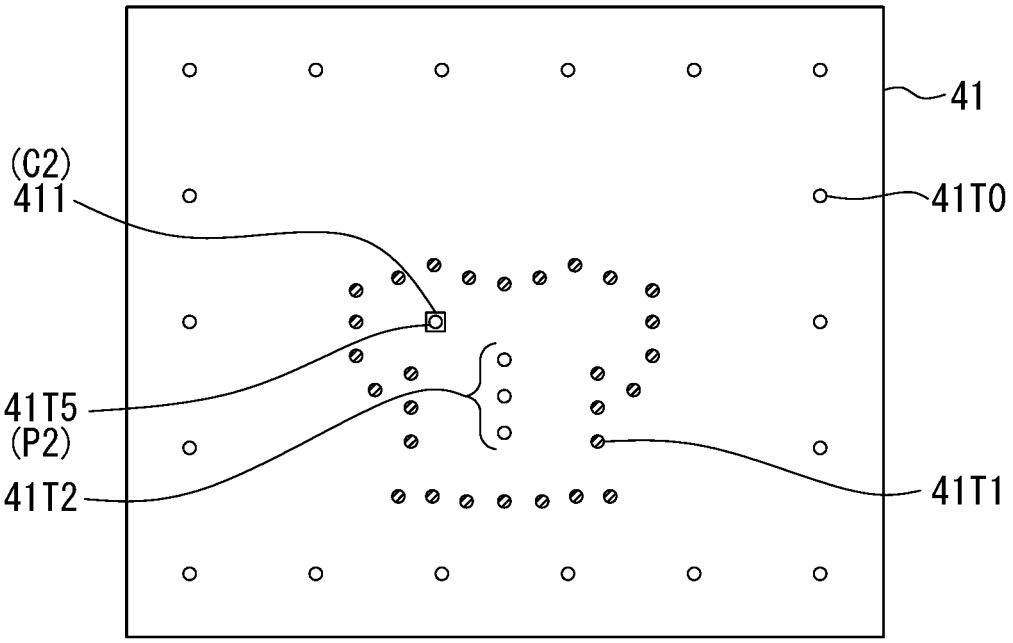

On the patterned surface of the eleventh dielectric layer 41, as shown in FIGS. 13A and 13B, there are formed four conductor layers 411 for forming four capacitors C2 of the four band-pass filters 10. The four conductor layers 411 are respectively opposed to the four resonator conductor sections 404 of the four band-pass filters 10 with the dielectric layer 40 interposed therebetween.

Further formed in the dielectric layer 41 are: a plurality of through holes 41T0 for forming the plurality of through hole lines 80; four sets of a plurality of through holes 41T1 for forming the four sets of the plurality of connection conductor sections 71; and four sets of a plurality of through holes 41T2 for forming the four sets of the plurality of partition conductor sections 72. Further formed in the dielectric layer 41 are four through holes 41T5 for forming the four through hole lines 75. The four through holes 41T5 are connected to the four conductor layers 411. Each of the four through holes 41T5 corresponds to the second input/output port P2.

The plurality of through holes 40T0 formed in the dielectric layer 40 are connected to the plurality of through holes 41T0. The four sets of the plurality of through holes 40T1 formed in the dielectric layer 40 are connected to the four sets of the plurality of through holes 41T1. The four sets of the plurality of through holes 40T2 formed in the dielectric layer 40 are connected to the four sets of the plurality of through holes 41T2.

Figure 14A:
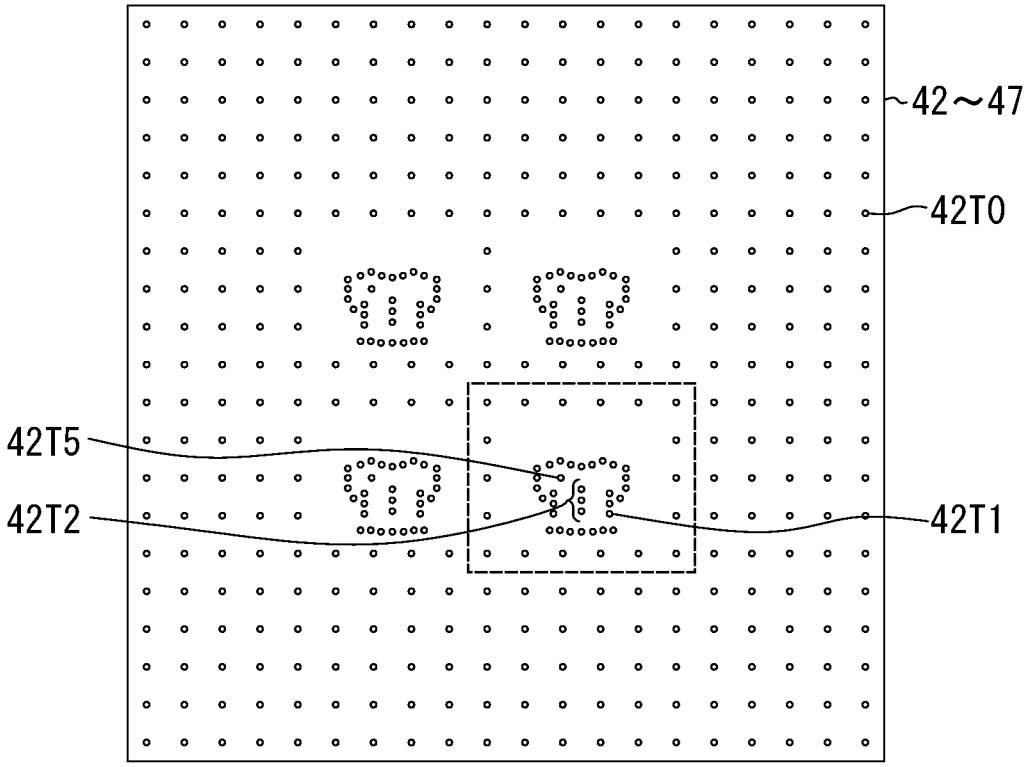
FIGS. 14A and 14B are explanatory diagrams showing a patterned surface of each of a twelfth to a seventeenth dielectric layer of the multilayer stack shown in FIG. 1.
Figure 14B:
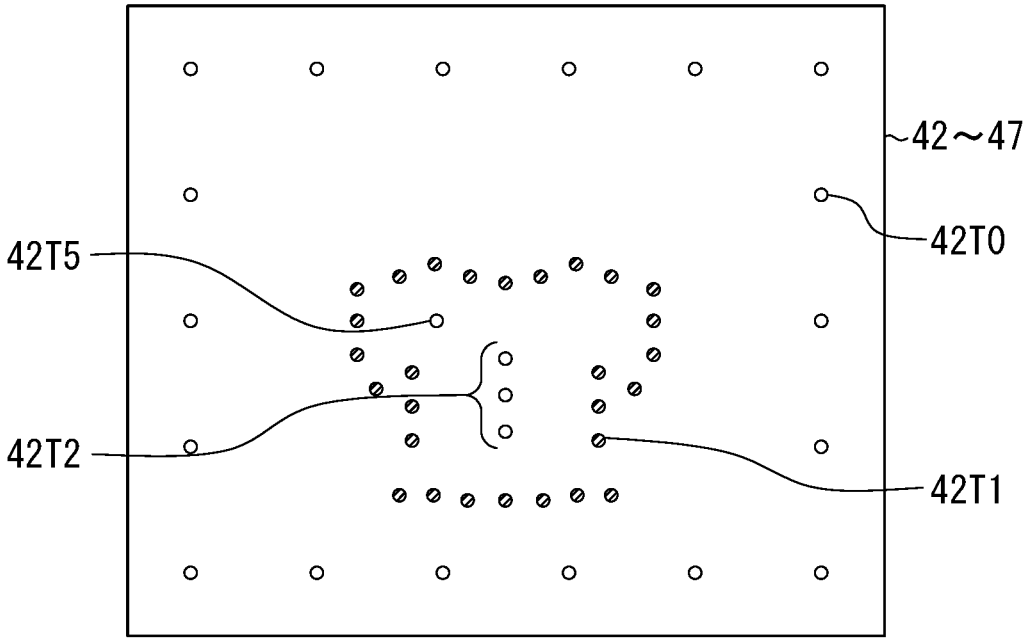

As shown in FIGS. 14A and 14B, a plurality of through holes 42T0 for forming the plurality of through hole lines 80 are formed in each of the twelfth to seventeenth dielectric layers 42 to 47. Further, four sets of a plurality of through holes 42T1 and four sets of a plurality of through holes 42T2 are formed in each of the dielectric layers 42 to 47. The four sets of the plurality of through holes 42T1 are used to form the four sets of the plurality of connection conductor sections 71. The four sets of the plurality of through holes 42T2 are used to form the four sets of the plurality of partition conductor sections 72. Further, four through holes 42T5 for forming the four through hole lines 75 are formed in each of the dielectric layers 42 to 47.

The plurality of through holes 41T0 formed in the dielectric layer 41 are connected to the plurality of through holes 42T0 formed in the twelfth dielectric layer 42. The four sets of the plurality of through holes 41T1 formed in the dielectric layer 41 are connected to the four sets of the plurality of through holes 42T1 formed in the dielectric layer 42. The four sets of the plurality of through holes 41T2 formed in the dielectric layer 41 are connected to the four sets of the plurality of through holes 42T2 formed in the dielectric layer 42. The four through holes 41T5 formed in the dielectric layer 41 are connected to the four through holes 42T5 formed in the dielectric layer 42.

In the dielectric layers 42 to 47, every vertically adjacent through holes denoted by the same reference signs are connected to each other.

Figure 15A:
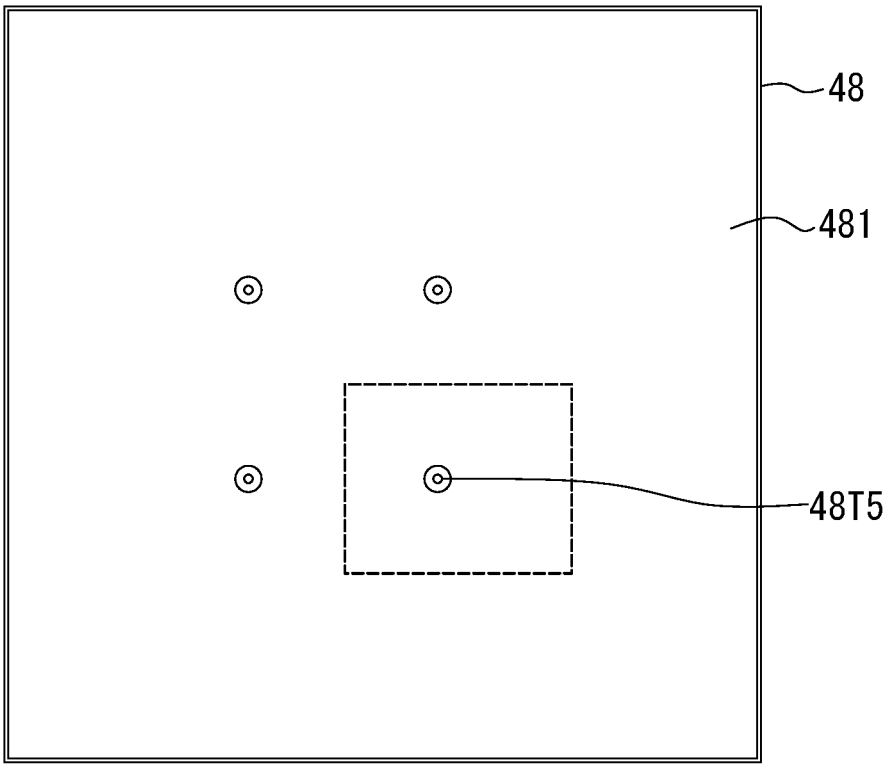
FIGS. 15A and 15B are explanatory diagrams showing a patterned surface of an eighteenth dielectric layer of the multilayer stack shown in FIG. 1.
Figure 15B:
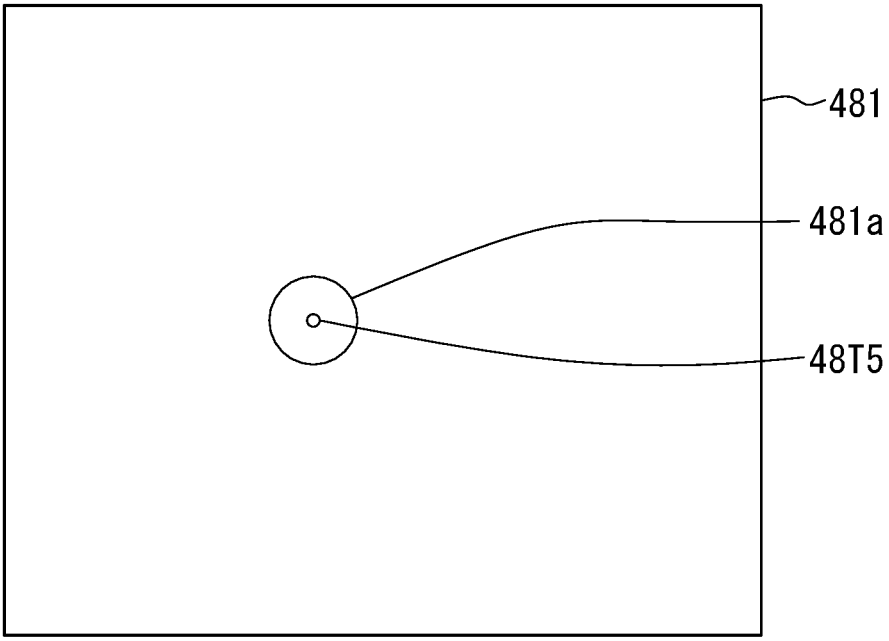

As shown in FIGS. 15A and 15B, the second ground conductor layer 481 is formed on the patterned surface of the eighteenth dielectric layer 48. Four circular holes 481*a* are formed in the second ground conductor layer 481.

Further formed in the dielectric layer 48 are four through holes 48T5 for forming the four through hole lines 75. The four through holes 48T5 are formed inside the four holes 481*a*, respectively. The four through holes 42T5 formed in the dielectric layer 47 are connected to the four through holes 48T5.

Figure 16A:
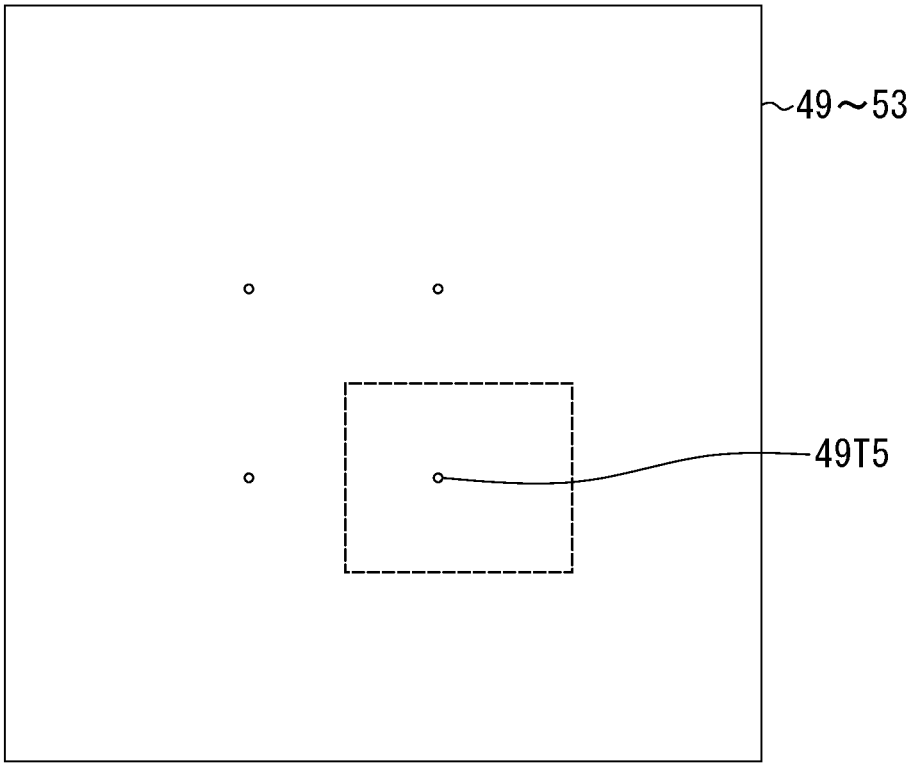
FIGS. 16A and 16B are explanatory diagrams showing a patterned surface of each of a nineteenth to a twenty-third dielectric layer of the multilayer stack shown in FIG. 1.
Figure 16B:
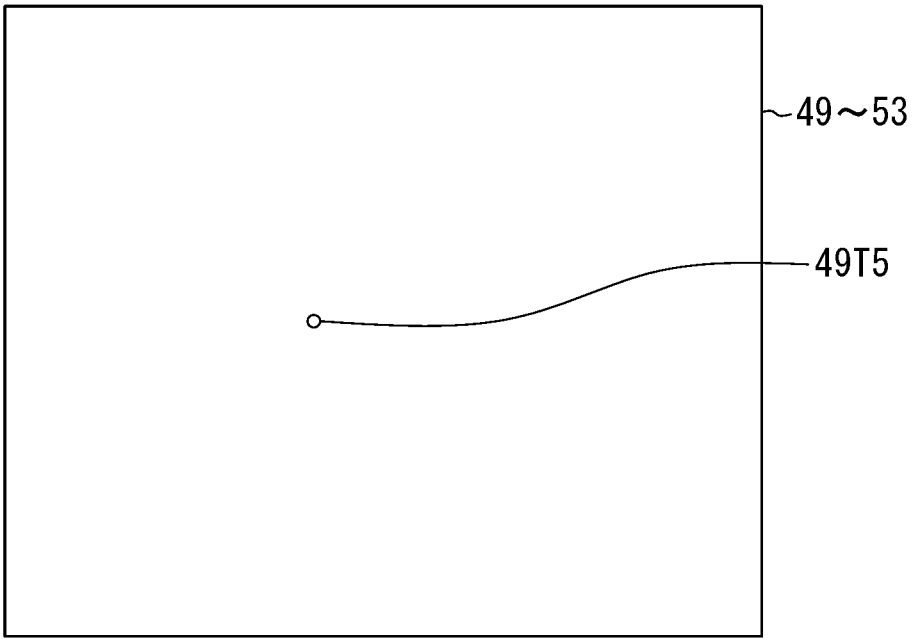

As shown in FIGS. 16A and 16B, four through holes 49T5 for forming the four through hole lines 75 are formed in each of the nineteenth to twenty-third dielectric layers 49 to 53. The four through holes 48T5 formed in the dielectric layer 48 are connected to the four through holes 49T5 formed in the nineteenth dielectric layer 49. In the dielectric layers 49 to 53, every vertically adjacent through holes 49T5 are connected to each other.

Figure 17A:
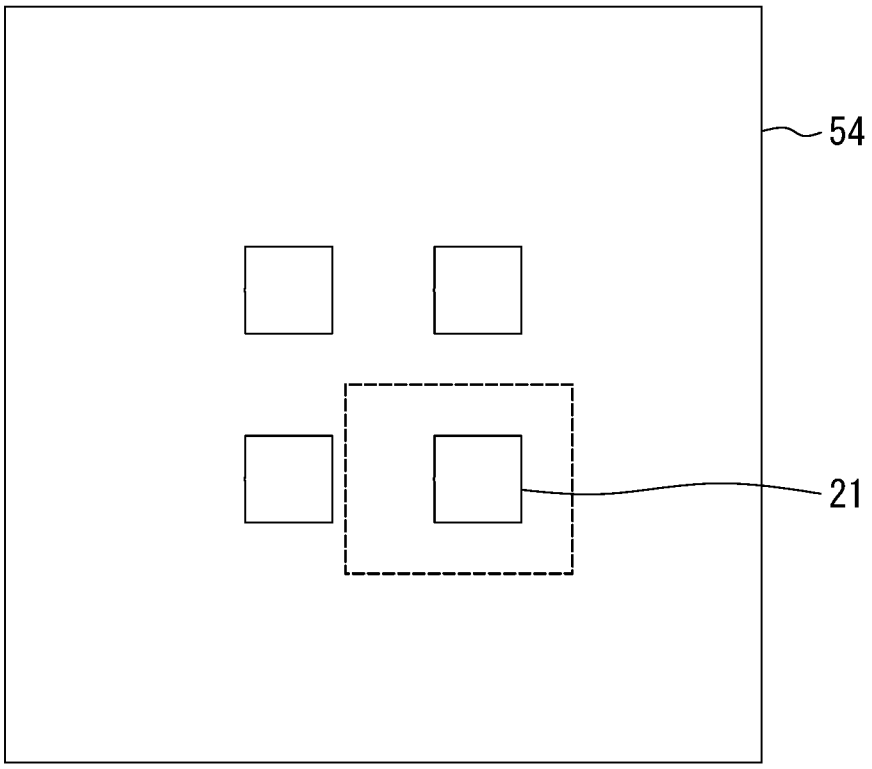
FIGS. 17A and 17B are explanatory diagrams showing a patterned surface of a twenty-fourth dielectric layer of the multilayer stack shown in FIG. 1.
Figure 17B:
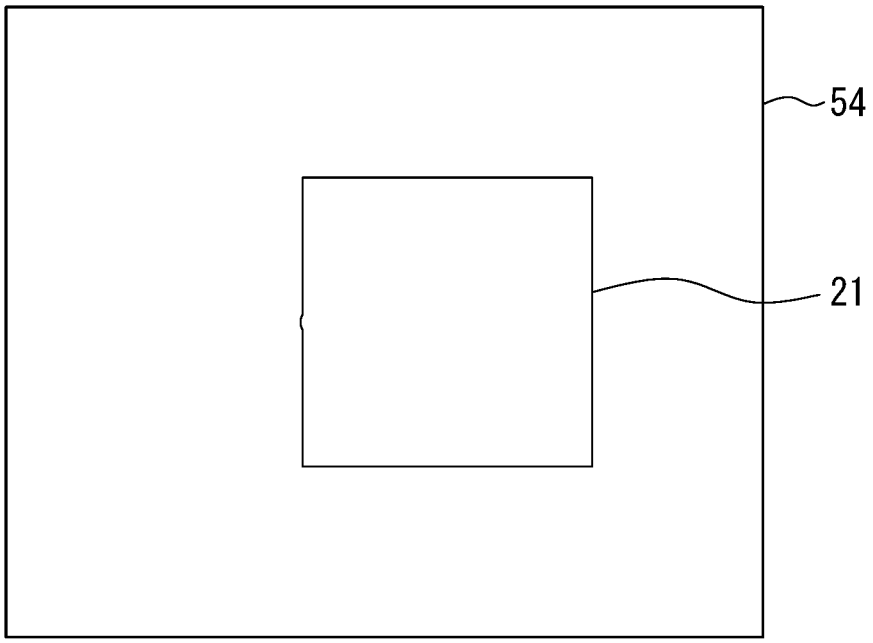

As shown in FIGS. 17A and 17B, four feed conductor layers 21 are formed on the twenty-fourth dielectric layer 54. The four through holes 49T5 formed in the dielectric layer 53 are connected to the four feed conductor layers 21.

No conductor layers or through holes are formed on/in each of the twenty-fifth to thirty-fifth dielectric layers 55 to 65.

Figure 18A:
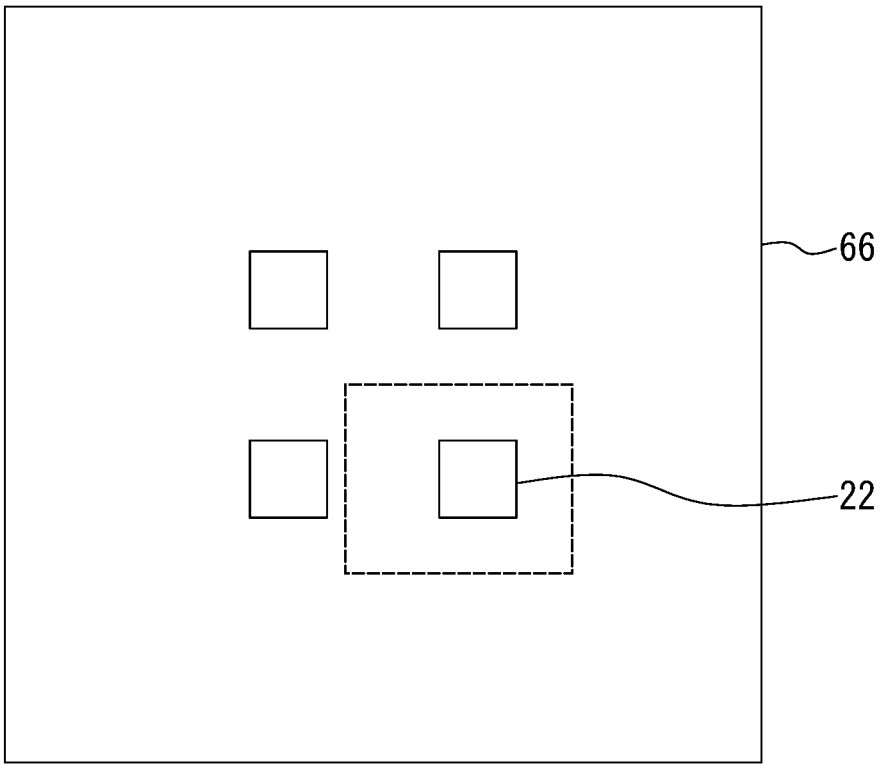
FIGS. 18A and 18B are explanatory diagrams showing a patterned surface of a thirty-sixth dielectric layer of the multilayer stack shown in FIG. 1.
Figure 18B:
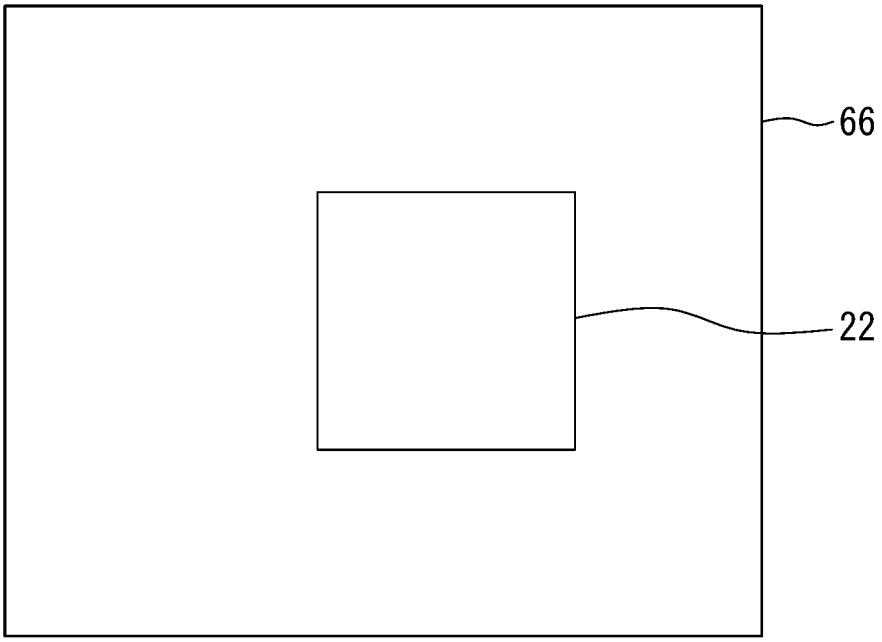

As shown in FIGS. 18A and 18B, four radiation elements 22 are formed on the patterned surface of the thirty-sixth dielectric layer 66. The four radiation elements 22 are respectively opposed to the four feed conductor layers 21 with the dielectric layers 54 to 65 interposed therebetween.

The multilayer stack 30 is formed by stacking the first to thirty-sixth dielectric layers 31 to 66 such that a surface of the thirty-sixth dielectric layer 66 opposite to the patterned surface serves as the top surface 50B.

Now, in connection with a single filter-antenna pair, a description will be given of correspondences between the circuit components shown in FIG. 7 and the components of the multilayer stack 30 shown in FIGS. 8A to 18B.

The resonators 11, 12, 13 and 14 of the band-pass filter 10 respectively include the resonator conductor sections 401, 402, 403 and 404 shown in FIG. 12B.

The input/output terminal T1 is connected to the conductor layer 391 shown in FIG. 11B via the through holes 31T3 and 32T3 and the six through holes 33T3 formed in the dielectric layers 33 to 38. The through hole 33T3 formed in the dielectric layer 38 corresponds to the first input/output port P1. The conductor layer 391 is opposed to the resonator conductor section 401 shown in FIG. 12B with the dielectric layer 39 interposed therebetween. The capacitor C1 shown in FIG. 7 is formed of the conductor layer 391, the resonator conductor section 401, and the dielectric layer 39 interposed therebetween.

The conductor layer 411 shown in FIG. 13B is opposed to the resonator conductor section 404 shown in FIG. 12B with the dielectric layer 40 interposed therebetween. The capacitor C2 shown in FIG. 7 is formed of the conductor layer 411, the resonator conductor section 404, and the dielectric layer 40 interposed therebetween.

The antenna 20 includes the feed conductor layer 21 shown in FIG. 17B and the radiation element 22 shown in FIG. 18B.

The through hole 41T5, the six through holes 42T5 formed in the dielectric layers 42 to 47, the through hole 48T5, and the five through holes 49T5 formed in the dielectric layers 49 to 53 constitute the through hole line 75 connecting the capacitor C2 and the feed conductor layer 21. The through hole 41T5 corresponds to the second input/output port P2.

First and second structural features of the composite electronic component 1 according to the embodiment and the effects resulting from those structural features will now be described. The first structural feature will be described first. The first structural feature is that the multilayer stack 30 includes a plurality of connection conductor sections 71.

In the composite electronic component 1 according to the embodiment, the plurality of conductor layers of the multilayer stack 30 include the first ground conductor layer 321 and the second ground conductor layer 481 which are located at different positions in the Z direction. The band-pass filter 10 lies within the spatial range from the first ground conductor layer 321 to the second ground conductor layer 481. The radiation element 22 of the antenna 20 is located on a side of the second ground conductor layer 481 opposite from the first ground conductor layer 321.

The multilayer stack 30 includes the plurality of connection conductor sections 71 connecting the first ground conductor layer 321 and the second ground conductor layer 481. Each of the plurality of connection conductor sections 71 includes through holes 32T1, 33T1, 39T1, 40T1, 41T1, and 42T1 connected in series.

The plurality of connection conductor sections 71 are arranged around the band-pass filter 10 such that one or more of the connection conductor sections 71 are situated to each of the front and the rear of the band-pass filter 10 in each of the X direction (the second direction) and the Y direction (the third direction). Being situated to the front and the rear of the band-pass filter 10 in the X direction refers to being situated forward of the band-pass filter 10 in the X direction and forward of the band-pass filter 10 in the −X direction. Being situated to the front and the rear of the band-pass filter 10 in the Y direction refers to being situated forward of the band-pass filter 10 in the Y direction and forward of the band-pass filter 10 in the −Y direction.

According to this embodiment, the provision of the plurality of connection conductor sections 71 prevents degradation of the characteristics of the band-pass filter 10 resulting from the first and second ground conductor layer 321 and 481. The reason therefor will be discussed below.

If the plurality of connection conductor sections 71 are not provided, the first and second ground conductor layers 321 and 481 would form a structure similar to a parallel plate waveguide in the multilayer stack 30, thereby generating one or more propagation modes for electromagnetic waves. The one or more propagation modes for electromagnetic waves may generate one or more unwanted resonances. The resonant frequencies of the one or more unwanted resonances are typically in a frequency region above the passband of the band-pass filter 10. If the resonant frequencies of the unwanted resonances are relatively close to the passband of the band-pass filter 10, the attenuation characteristic of the band-pass filter 10 in a frequency region above the passband suffers degradation.

The resonant frequencies of the aforementioned unwanted resonances depend on the shape of a space defined by conductors including the first and second ground conductor layers 321 and 481. Typically, the smaller the space, the higher the resonant frequencies of the unwanted resonances.

According to this embodiment, by virtue of the plurality of connection conductor sections 71 included in the multilayer structure 30, the space defined by the plurality of connection conductor sections 71 and the first and second ground conductor layers 321 and 481 is smaller than a space that would be defined by the first and second ground conductor layers 321 and 481 and other conductors in the absence of the plurality of connection conductor sections 71. The embodiment thus allows the resonant frequencies of unwanted resonances to be higher than in the case without the plurality of connection conductor sections 71. This makes it possible to prevent the attenuation characteristic of the band-pass filter 10 in a frequency region above the passband from deteriorating due to the first and second ground conductor layers 321 and 481.

According to the embodiment, the space defined by the conductors including the first and second ground conductor layers 321 and 481 is made even smaller by the plurality of partition conductor sections 72 included in the multilayer stack 30. This makes it possible to prevent, with higher reliability, the attenuation characteristic of the band-pass filter 10 in a frequency region above the passband from deteriorating due to the first and second ground conductor layers 321 and 481.

The smaller the spacing between adjacent ones of the plurality of connection conductor sections 71, the more reliably the connection conductor sections 71 exert the above-described effect. From this point of view, the plurality of connection conductor sections 71 are preferably arranged with a spacing smaller than or equal to ¼ the wavelength corresponding to the center frequency of the passband of the band-pass filter 10, that is, smaller than or equal to the length of each of the resonator conductor sections 401, 402, 403 and 404, between adjacent ones of the connection conductor sections 71. From the same point of view, the plurality of connection conductor sections 71 are preferably arranged with a spacing of 1.25 mm or less, more preferably 500 μm or less, between adjacent ones of the connection conductor sections 71. The wavelength in free space corresponding to 30 GHz is approximately 10 mm. 1.25 mm is approximately ⅛ the wavelength in free space corresponding to 30 GHz, and 500 μm is approximately 1/20 the wavelength in free space corresponding to 30 GHz.

Further, the closer the connection conductor sections 71 are brought to the band-pass filter 10, the more reliably the connection conductor sections 71 exert the above-described effect. From this point of view, each of the connection conductor sections 71 is preferably situated such that the distance from the nearest one of the resonator conductor sections is smaller than or equal to ¼ the wavelength corresponding to the center frequency of the passband of the band-pass filter 10.

Now, a description will be given of the results of a first simulation demonstrating the effect of the first structural feature. The first simulation compared characteristics between the composite electronic component 1 according to the embodiment and a composite electronic component of a first comparative example.

Figure 19:
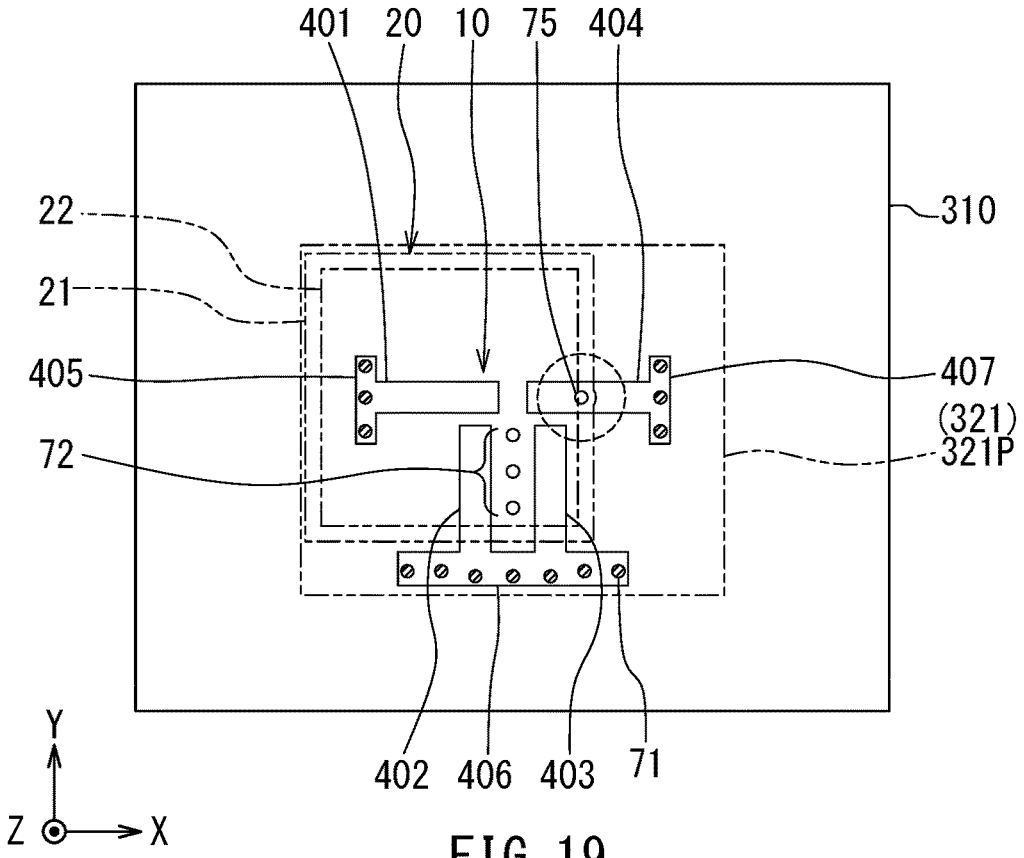
FIG. 19 RELATED ART
FIG. 19 is a plan view of a main part of a composite electronic component of a first comparative example.

FIG. 19 is a plan view of the main part of the composite electronic component of the first comparative example. FIG. 19 corresponds to FIG. 6. In the composite electronic component 1 according to the embodiment, the plurality of connection conductor sections 71 include ones that are connected to none of the shield conductor sections 405, 406 and 407. In contrast, in the composite electronic component of the first comparative example, the connection conductor sections 71 include no such ones. As a result, in the first comparative example, there are no connection conductor sections 71 situated to the front of the band-pass filter 10 in the Y direction. Further, in the first comparative example, large spaces in which no conductors are present are formed between the shield conductor sections 405 and 406 and between the shield conductor sections 406 and 407. The connection conductor sections 71 of the first comparative example fail to satisfy the requirements for the connection conductor sections of the present invention. Further, the plurality of through hole lines 80 are not provided in the first comparative example. The remainder of configuration of the composite electronic component of the first comparative example is the same as that of the composite electronic component 1 according to the embodiment.

Figure 20:
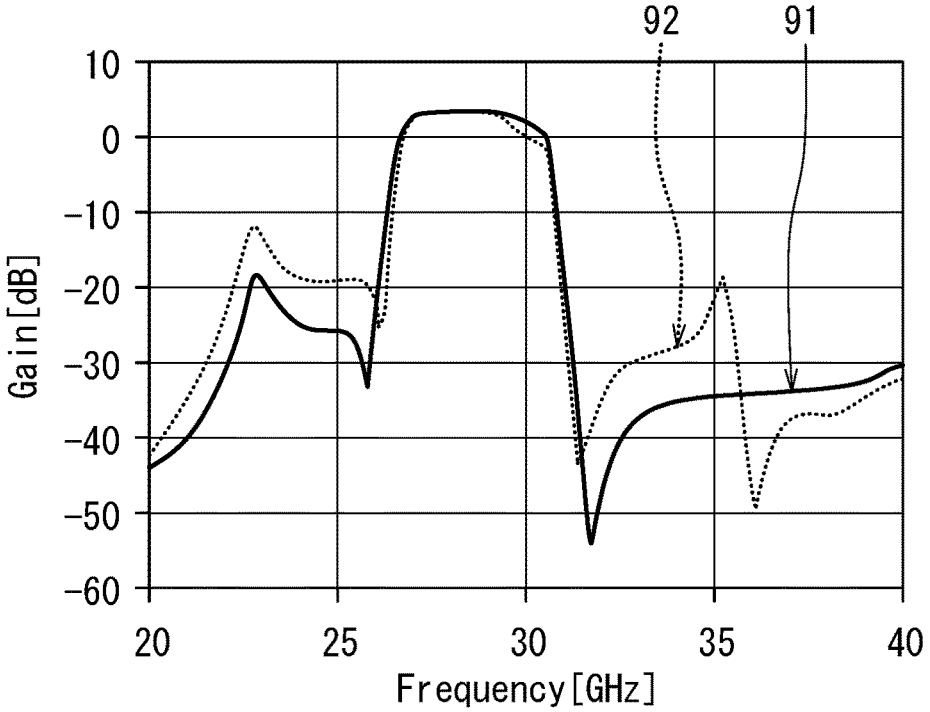
FIG. 20 is a characteristic diagram showing the characteristics of the composite electronic component according to the embodiment of the invention and the composite electronic component of the first comparative example.

FIG. 20 shows the results of the first simulation. FIG. 20 illustrates the frequency response of the directive gain in the Z direction of the antenna 20 for each of the composite electronic component of the first comparative example and the composite electronic component 1 according to the embodiment. In FIG. 20, the horizontal axis represents frequency, and the vertical axis represents the directive gain in the Z direction of the antenna 20. In FIG. 20, the line designated by the reference numeral 91 represents the characteristic of the composite electronic component 1 according to the embodiment, and the line designated by the reference numeral 92 represents the characteristic of the composite electronic component of the first comparative example. The frequency response of the directive gain in the Z direction of the antenna 20 in FIG. 20 corresponds to the frequency response of the insertion loss of the band-pass filter 10. In the example shown in FIG. 20, for both of the composite electronic component 1 according to the embodiment and the composite electronic component of the first comparative example, the band-pass filter 10 has a passband of approximately 27.5 to 29.5 GHz, and the center frequency of the passband is approximately 28.5 GHz.

As shown in FIG. 20, the characteristic 92 of the composite electronic component of the first comparative example has a peak, at approximately 35 GHz, where the gain rises. This is considered to be due to the occurrence of unwanted resonance having a resonant frequency of approximately 35 GHz in the first comparative example. Due to the presence of the aforementioned peak, the characteristic 92 shows a deterioration in the attenuation characteristic of the band-pass filter 10 in the frequency region above the passband. In contrast, the characteristic 91 of the composite electronic component 1 according to the embodiment shows no such peak as that occurring in the characteristic 92, thus exhibiting better attenuation characteristic of the band-pass filter 10 in the frequency region above the passband, compared to that of the characteristic 92. It can be seen from FIG. 20 that the embodiment is capable of preventing the attenuation characteristic of the band-pass filter 10 in the frequency region above the passband from deteriorating due to the first and second ground conductor layers 321 and 481.

Next, the second structural feature will be described. The second structural feature is that when viewed in a direction parallel to the Z direction, the radiation element 22 entirely lies inside the perimeter of the second ground conductor layer 481. By virtue of this feature, the embodiment prevents distortion of the radiation pattern of the antenna 20 due to the second ground conductor layer 481. The reason therefor will be discussed below.

In the embodiment, the radiation element 22 radiates electromagnetic waves with a main radiation direction in the Z direction. The electromagnetic waves are radiated out of the multilayer stack 30 through the top surface 30B thereof. From the radiation element 22, electromagnetic waves are also radiated toward the band-pass filter 10, and part of the electromagnetic waves are reflected off the second ground conductor layer 481 and go out of the multilayer stack 30 through the top surface 30B thereof. The electromagnetic waves that are reflected off the second ground conductor layer 481 and go out of the multilayer stack 30 will hereinafter be referred to as reflected waves. The reflected waves exert influence on the radiation pattern of the antenna 20.

The results of a second simulation demonstrating the effect of the second structural feature will now be described. The second simulation compared characteristics between the composite electronic component 1 according to the embodiment and a composite electronic component of a second comparative example.

Figure 21:
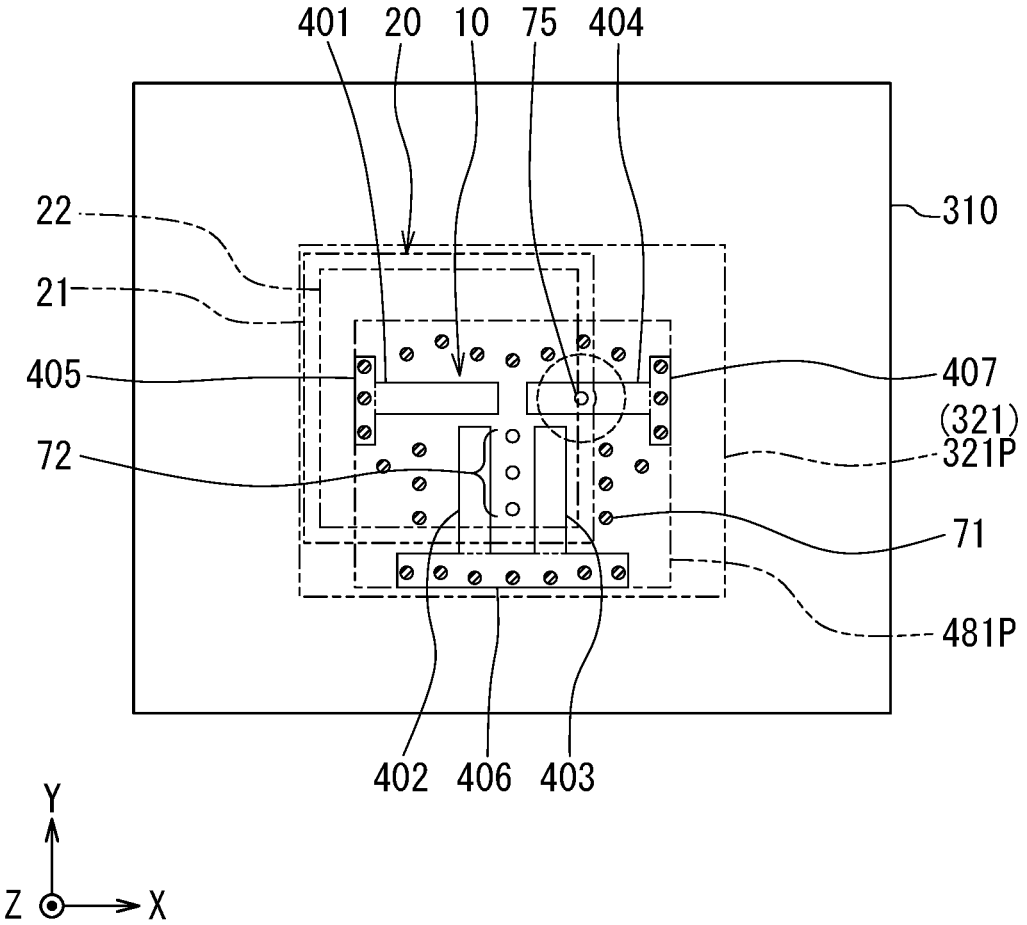
FIG. 21 RELATED ART
FIG. 21 is a plan view of a main part of a composite electronic component of a second comparative example.
Figure 22:
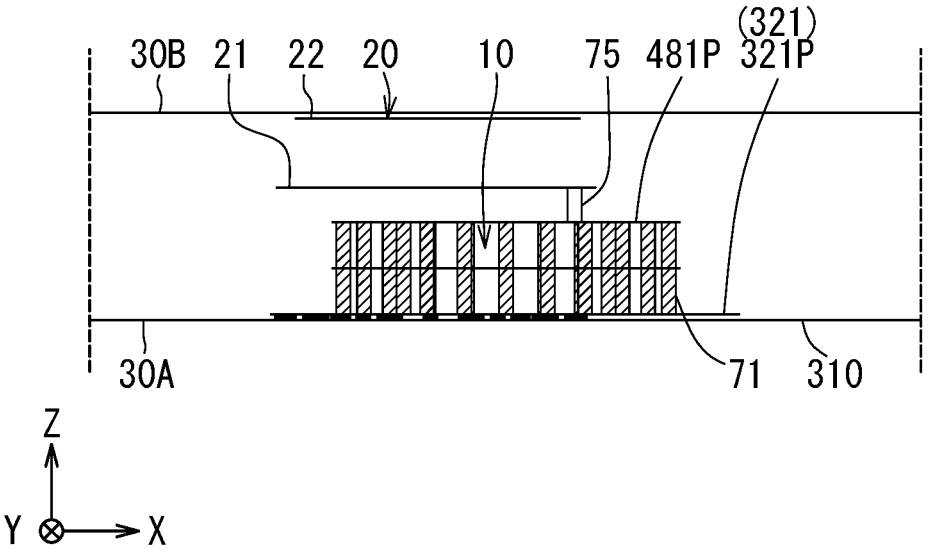
FIG. 22 RELATED ART
FIG. 22 is a side view of the main part of the composite electronic component of the second comparative example.

FIG. 21 is a plan view of the main part of the composite electronic component of the second comparative example. FIG. 22 is a side view of the main part of the composite electronic component of the second comparative example. FIG. 21 corresponds to FIG. 6. FIG. 22 corresponds to FIG. 4. As shown in FIGS. 21 and 22, the composite electronic component of the second comparative example is provided with a ground conductor layer 481P instead of the second ground conductor layer 481.

As shown in FIG. 21, the ground conductor layer 481P is shaped to be smaller than the partial conductor layer 321P when viewed in a direction parallel to the Z direction. When viewed in a direction parallel to the Z direction, the ground conductor layer 481P is offset with respect to the center of the radiation element 22. More specifically, when viewed in a direction parallel to the Z direction, the center of the ground conductor layer 481P and the center of the radiation element 22 do not coincide with each other, and the ground conductor layer 481P and the radiation element 22 overlap each other. When viewed in a direction parallel to the Z direction, part of the perimeter of the ground conductor layer 481P lies outside the perimeter of the radiation element 22, whereas the remaining part of the perimeter of the ground conductor layer 481P does not. Further, the plurality of through hole lines 80 are not provided in the second comparative example. The remainder of configuration of the composite electronic component of the second comparative example is the same as that of the composite electronic component 1 according to the embodiment.

Figure 23:
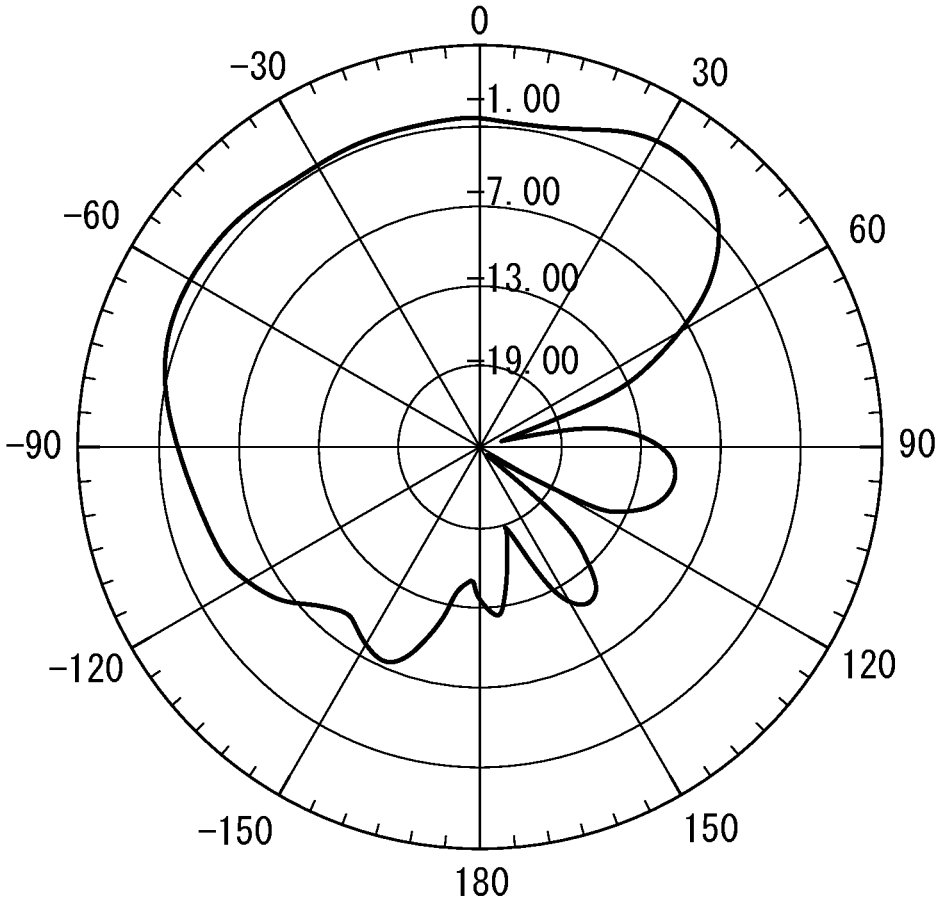
FIG. 23 RELATED ART
FIG. 23 is a characteristic diagram showing a radiation pattern for the composite electronic component of the second comparative example.
Figure 24:
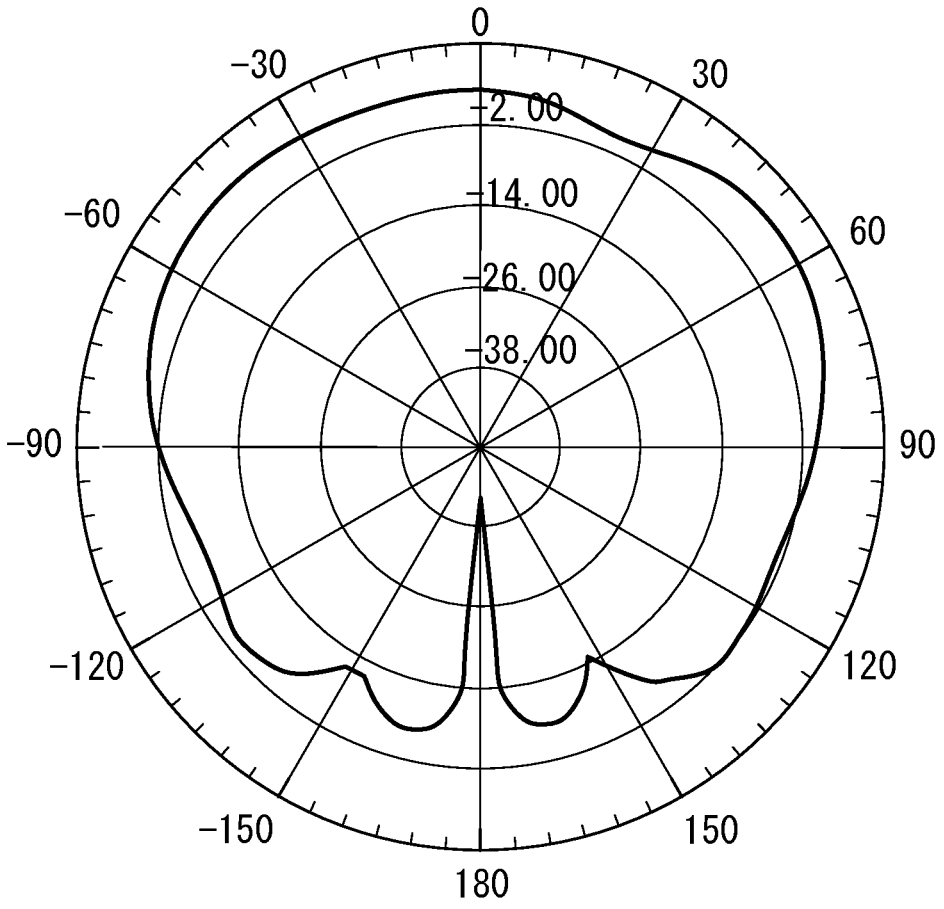
FIG. 24 is a characteristic diagram showing a radiation pattern for the composite electronic component according to the embodiment of the invention.

FIGS. 23 and 24 show the results of the second simulation. FIG. 23 is a characteristic diagram showing the radiation pattern for the composite electronic component of the second comparative example. FIG. 24 is a characteristic diagram showing the radiation pattern for the composite electronic component 1 according to the embodiment. Both of the radiation patterns of the antenna 20 shown in FIGS. 23 and 24 are those in an XZ plane including the center of the top surface of the radiation element 22. In FIGS. 23 and 24, the circumferential scale indicates an angle of the radiation direction with respect to the Z direction. In FIGS. 23 and 24, angles as viewed in a clockwise direction from the Z direction are expressed in positive values, and angles as viewed in a counterclockwise direction from the Z direction are expressed in negative values. In FIGS. 23 and 24, the radial scale indicates the directive gain.

As shown in FIG. 23, the radiation pattern for the composite electronic component of the second comparative example exhibits poor symmetry in the range from 0° to 90° and in the range from 0° to −90°. This indicates that the radiation pattern of the antenna 20 is distorted. The cause of the distortion is considered to be as follows. As described above, the second comparative example is provided with the ground conductor layer 481P which is shaped to be relatively small and offset with respect to the center of the radiation element 22 when viewed in a direction parallel to the Z direction. As a result, when viewed in a cross section including a virtual central axis that is parallel to the Z direction and passes through the center of the top surface of the radiation element 22, the second comparative example is poor in symmetry of the strength and phase of reflected waves with respect to the aforementioned central axis. This is presumably the cause of the distortion of the radiation pattern of the antenna 20 in the second comparative example.

In contrast, as shown in FIG. 24, the radiation pattern for the composite electronic component 1 according to the embodiment exhibits good symmetry in the range from 0° to 90° and in the range from 0° to −90°. This is considered to be because the radiation element 22 entirely lies inside the perimeter of the second ground conductor layer 481 when viewed in a direction parallel to the Z direction. Such a structural feature is considered to provide good symmetry of the strength and phase of radiation waves with respect to the aforementioned central axis in a cross section including the central axis, thus preventing distortion of the radiation pattern of the antenna 20.

Furthermore, the second structural feature of the embodiment allows the second ground conductor layer 481 to be larger than the radiation element 22 when viewed in a direction parallel to the Z direction. This is suitable to provide the first structural feature. To be more specific, forming the second ground conductor layer 481 to be large when viewed in a direction parallel to the Z direction allows the second ground conductor layer 481 to have a sufficient region for connection with the connection conductor sections 71, and provides a higher degree of design flexibility in the number and arrangement of the connection conductor sections 71.

Furthermore, in the embodiment, all the four radiation elements 22 entirely lie inside the perimeter of the second ground conductor layer 481 when viewed in a direction parallel to the Z direction. This allows the second ground conductor layer 481 to be even larger when viewed in a direction parallel to the Z direction, thereby allowing the above-described effect of the second ground conductor layer 481 to be exerted with higher reliability.

The present invention is not limited to the foregoing embodiment, and various modifications may be made thereto. For example, the composite electronic component of the present invention may be configured with a single filter and a single antenna.

The configuration of the band-pass filter illustrated in the foregoing embodiment is non-limiting. For example, the band-pass filter may be configured with two, three, or five or more resonators.

The configuration of the antenna illustrated in the foregoing embodiment is non-limiting. For example, the antenna may be configured to directly supply power to the radiation element.

Further, the filter in the composite electronic component of the present invention may be other than a band-pass filter.

Obviously, many modifications and variations of the present invention are possible in the light of the above teachings. Thus, it is to be understood that, within the scope of the appended claims and equivalents thereof, the invention may be practiced in other than the foregoing most preferable embodiment.

What is claimed is:

1. A composite electronic component comprising:

a multilayer stack including a plurality of dielectric layers and a plurality of conductor layers that are stacked in a first direction; and one or more filters and one or more antennas making up one or more filter-antenna pairs, wherein each of the one or more filter-antenna pairs is made up of one filter of the one or more filters and one antenna of the one or more antennas, wherein the one filter and the one antenna are electrically connected to each other, the plurality of conductor layers include a first ground conductor layer and a second ground conductor layer each connected to a ground, the first ground conductor layer and the second ground conductor layer are located at different positions in the first direction, the filter lies within a spatial range from the first ground conductor layer to the second ground conductor layer, the antenna includes a radiation element formed of one of the plurality of conductor layers, the radiation element is located on a side of the second ground conductor layer opposite from the first ground conductor layer, when viewed in a direction parallel to the first direction, the radiation element entirely lies inside a perimeter of the second ground conductor layer, the multilayer stack further includes a plurality of connection conductor sections for connecting the first ground conductor layer and the second ground conductor layer, and the plurality of connection conductor sections are arranged around the filter such that one or more of the connection conductor sections are situated to each of a front and a rear of the filter in each of a second direction and a third direction, the second direction and the third direction being orthogonal to the first direction and orthogonal to each other.

2. The composite electronic component according to claim 1, wherein each of the plurality of connection conductor sections includes a plurality of through holes connected in series.

3. The composite electronic component according to claim 1, wherein the filter is a band-pass filter including a plurality of resonators.

4. The composite electronic component according to claim 3, wherein the plurality of connection conductor sections are arranged with a spacing between adjacent ones of the connection conductor sections, the spacing being smaller than or equal to ¼ a wavelength corresponding to a center frequency of a passband of the band-pass filter.

5. The composite electronic component according to claim 3, wherein the plurality of resonators respectively include resonator conductor sections each shaped to be long in a direction intersecting the first direction.

6. The composite electronic component according to claim 5, wherein each of the plurality of connection conductor sections is situated such that a distance from a nearest one of the resonator conductor sections is smaller than or equal to ¼ a wavelength corresponding to a center frequency of a passband of the band-pass filter.

7. The composite electronic component according to claim 1, wherein the plurality of connection conductor sections are arranged with a spacing of 1.25 mm or less between adjacent ones of the connection conductor sections.

8. The composite electronic component according to claim 1, wherein the one or more filter-antenna pairs are a plurality of filter-antenna pairs, the one or more filters are a plurality of filters, the one or more antennas are a plurality of antennas, and a plurality of sets of the plurality of connection conductor sections are provided to correspond to the plurality of filter-antenna pairs.

9. The composite electronic component according to claim 8, wherein the plurality of antennas include their respective radiation elements, and when viewed in a direction parallel to the first direction, all the radiation elements entirely lie inside the perimeter of the second ground conductor layer.

10. The composite electronic component according to claim 8, wherein the first ground conductor layer includes a plurality of partial conductor layers respectively corresponding to the plurality of filter-antenna pairs, and the plurality of partial conductor layers are separated from each other.

* * * * *